US010408001B2

(12) United States Patent
Buchanan et al.

(10) Patent No.: US 10,408,001 B2
(45) Date of Patent: Sep. 10, 2019

(54) SELF CONTAINED/SELF POWERED HYDRAULIC CATWALK

(71) Applicants: Max Buchanan, Denton, TX (US); Bryson Davis, Snyder, OK (US)

(72) Inventors: Max Buchanan, Denton, TX (US); Bryson Davis, Snyder, OK (US)

( * ) Notice: Subject to any disclaimer, the term of this patent is extended or adjusted under 35 U.S.C. 154(b) by 0 days.

(21) Appl. No.: 15/248,346

(22) Filed: Aug. 26, 2016

(65) Prior Publication Data

US 2018/0058159 A1 Mar. 1, 2018

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/15; E21B 19/14; E21B 19/08; E21B 19/20; B08B 9/043
USPC ..... 414/22.51–22.59, 22.61–22.69, 22.71
See application file for complete search history.

(56) References Cited

U.S. PATENT DOCUMENTS 2,643,006 A * 6/1953 King ..... E21B 19/155 414/22.52
2,873,716 A * 2/1959 Daniel ..... B22D 13/102 118/318
3,083,842 A * 4/1963 Bauer ..... E21B 19/15 414/22.61
3,254,776 A * 6/1966 Brown ..... B65G 1/08 193/17
3,464,507 A * 9/1969 Smith ..... E21B 19/155 166/77.52
3,780,883 A * 12/1973 Brown ..... E21B 19/15 175/85
4,067,453 A * 1/1978 Moller ..... E21B 19/155 175/85
4,386,883 A * 6/1983 Hogan ..... E21B 19/155 414/22.61
4,832,552 A * 5/1989 Skelly ..... E21B 3/02 173/164
5,397,209 A * 3/1995 Heim ..... B23Q 7/001 187/243
6,969,223 B2 * 11/2005 Tolmon ..... E21B 19/155 414/22.54
7,021,880 B2 * 4/2006 Morelli ..... E21B 19/15 414/22.59
7,992,646 B2 * 8/2011 Wright ..... E21B 19/155 166/379

(Continued)

FOREIGN PATENT DOCUMENTS

CA 2224638 C * 2/2004 ..... E21B 19/14
SU 1740616 A1 * 6/1992

*Primary Examiner* — Gregory W Adams
(74) *Attorney, Agent, or Firm* — David G. Moore

(57) ABSTRACT

A self contained/self powered hydraulic catwalk is equipped with a slider positioned at the base of a lifting arm. As the lifting arm is elevated to deliver pipe to the drill rig floor, the slider moves the base of the lifting arm toward the drill rig keeping the distal end of the lifting arm in close proximity to the drill rig floor. Conversely, when the lifting arm is lowered, the slider retracts the base of the lifting arm onto the catwalk. By this method it is not necessary to reposition the catwalk after raising or lowering the lifting arm to maintain close proximity to the drill rig. Pipe can then be transported to the drill floor or removed efficiently and safely.

24 Claims, 22 Drawing Sheets

(56) References Cited

U.S. PATENT DOCUMENTS

| | | | | |
|---|---|---|---|---|
| 8,113,762 | B2 * | 2/2012 | Belik | E21B 19/15 414/22.62 |
| 8,454,296 | B2 * | 6/2013 | Gerber | E21B 19/15 198/468.6 |
| 8,511,963 | B1 * | 8/2013 | Bunch | E21B 19/155 414/22.57 |
| 2011/0188973 | A1 * | 8/2011 | Baumler | E21B 19/15 414/22.57 |
| 2013/0251491 | A1 * | 9/2013 | Ludwig | E21B 19/14 414/745.8 |
| 2013/0266404 | A1 * | 10/2013 | Tolman | E21B 19/15 414/22.59 |
| 2014/0030045 | A1 * | 1/2014 | Beck | E21B 19/155 414/22.58 |
| 2014/0093347 | A1 * | 4/2014 | Thomas | E21B 37/00 414/800 |
| 2016/0356103 | A1 * | 12/2016 | Buchanan | E21B 19/15 |

* cited by examiner

SELF CONTAINED/SELF POWERED HYDRAULIC CATWALK

CROSS-REFERENCE TO RELATED APPLICATIONS

This utility patent application seeks priority to and benefit of U.S. Provisional Patent application No. 62/210,654 filed on Aug. 27, 2015 and which is incorporated herein by reference as if fully set forth.

STATEMENT REGARDING FEDERALLY SPONSORED RESEARCH OR DEVELOPMENT

No part of the invention disclosed herein was the subject of federally sponsored research or development.

THE NAMES OF THE PARTIES TO A JOINT RESEARCH AGREEMENT

Not applicable

REFERENCE TO A SEQUENCE LISTING

Not applicable

BACKGROUND

Field

The field of the invention disclosed herein is oil field drilling and movement of pipe to the drilling platform

Description of the Prior Art

Extraction of oil, natural gas, water and other valuable materials from deep in the earth requires drilling a hole to the reservoir holding the valuable materials and inserting pipe, also called tubulars, of various lengths and circumferences into the hole. The pipe are connected together to form a long tube through which the valuable materials are extracted and through which drilling chemicals are injected into the reservoir to stabilize the hole and assist in extracting the valuable materials. Some of the drilled holes may require thousands of feet of pipe in order to reach the reservoir of valuable materials. The pipe must be delivered to the drill site and raised onto the drilling platform for connection to another section of pipe prior to insertion into the hole. The economic feasibility of drilling for oil, natural gas, water and other valuable materials demands that the pipe be quickly, safely and efficiently lifted onto the drilling platform. When drilling is completed it is necessary to remove the pipe from the drill hole. In that circumstance the process is reversed. The pipe is removed from the hole and disengaged from the next section of pipe on the drilling platform. The disconnected pipe must then be lowered from the drilling platform quickly, efficiently and safely for another use. Prior art devices to move pipe from the ground to the drilling platform must be repositioned in order for the lifting arm to be in juxtaposition with the drilling platform. As shown in FIGS. 1*a* and 1*b* when the prior art pipe handling catwalk is positioned at the drill site, initially the lifting mechanism is horizontal and underneath the drill floor. However, as shown in FIG. 1*b*, when the lifting mechanism is elevated to move pipe to the drill floor there is a substantial gap between the end of the lifting mechanism and the drill floor because the lifting mechanism must pivot while it is being elevated. This necessitates either repositioning the pipe handling catwalk or extending the lift mechanism while in the up position. This process is costly, time consuming and potentially dangerous. The problem solved by the invention disclosed herein is a device which quickly, efficiently and safely allows pipe to be lifted to the drilling platform or removed from the drilling platform without having to reposition the catwalk or add an extension mechanism to bridge the gap between the catwalk and the drilling platform.

BRIEF DESCRIPTION OF THE INVENTION

The invention disclosed herein is a device which is a self contained/self powered hydraulic catwalk for pipe handling, pipe lay down and pipe pickup primarily for service rigs but may also be used in other drilling operations at the drill site. In the preferred embodiment, the main components of the self contained/self powered hydraulic catwalk are: 1) a lifting arm, 2) a plurality of pipe indexers, 3) a plurality of pipe kickers, 4) a power supply, 5) hydraulic system, 6) rollers, 7) hydraulically powered sled with a shock absorbing push face, 9) a trough running the long axis of the self contained/self powered hydraulic catwalk, 10) a hydraulically powered lifting arm and boom, 11) a lift arm slider and 12) a frame to which the components of the self contained/self powered hydraulic catwalk are mounted. The addition of the lift arm slider permits the lift arm to remain in close proximity to the oil rig drill floor without the necessity of repositioning. The frame may be affixed with an axle or used as a skid. In the configuration in which the frame of the self contained/self powered hydraulic catwalk is affixed with an axle, the frame may be equipped with a hydraulic pivoting axle or removable axle to lower the self contained/self powered hydraulic catwalk to the ground for operation.

BRIEF DESCRIPTION OF THE DRAWING/FIGURES

A better understanding of the invention disclosed herein may be had by examination of the following drawings/figures:

FIG. 1*a* is a side view of a prior art catwalk

FIG. 1*b* is a side view of a prior art catwalk.

FIG. 1*c* is a side view of the catwalk with the lifting arm in horizontal position.

FIG. 1*d* is a side view of the catwalk with the lifting arm in elevated position.

FIG. 1*e* is a side view of the catwalk with the lifting arm in horizontal position.

FIG. 1*f* is a side view of the catwalk with the lifting arm in elevated position.

Figure 4A:
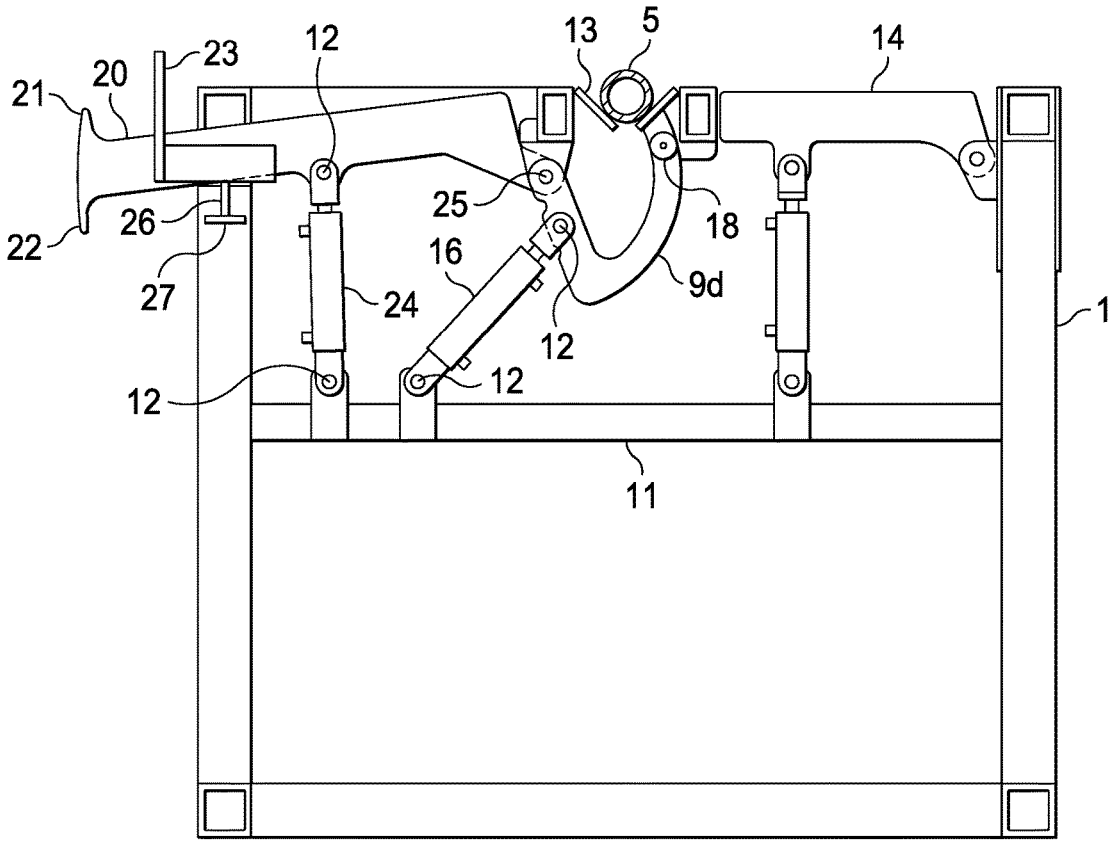

FIG. 4*a* is an end view of the catwalk showing the indexer and kicker mechanism.

Figure 4B:
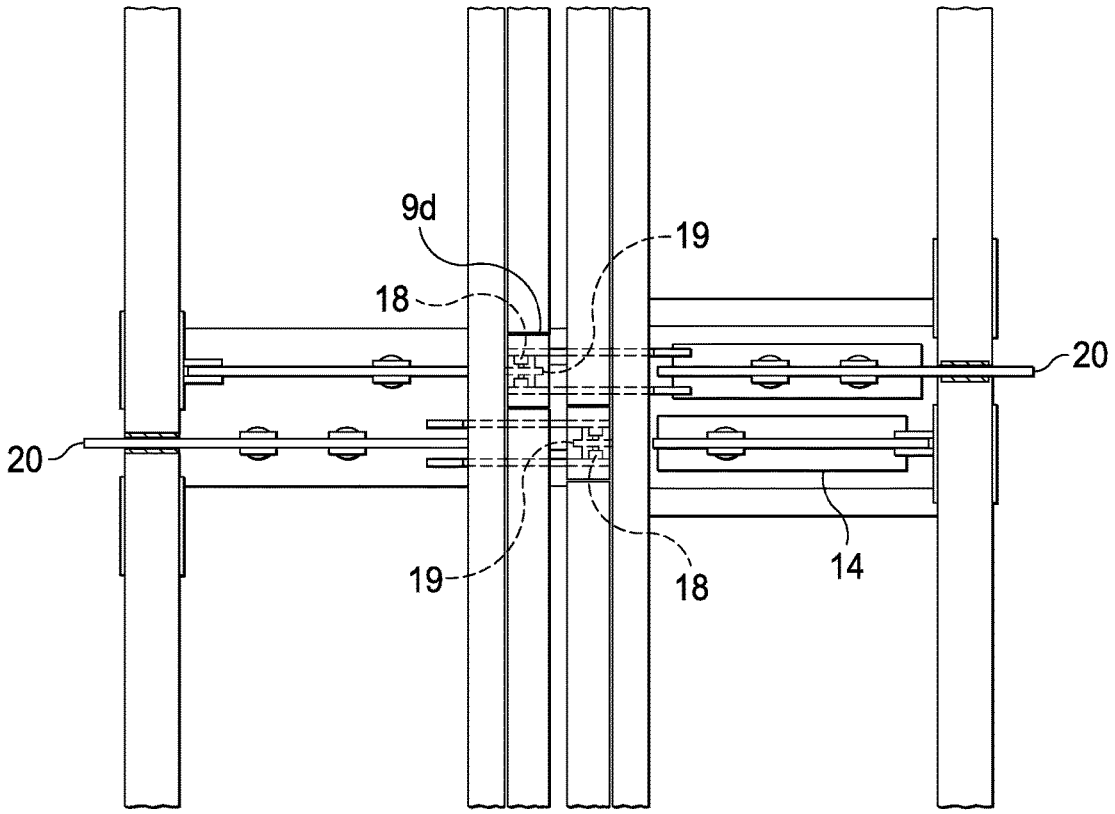

FIG. 4*b* is a top view of the catwalk showing the indexer and roll off mechanisms.

Figure 5A:
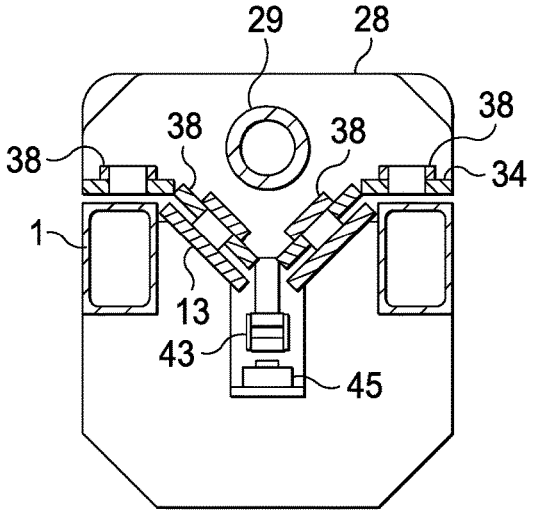

FIG. 5*a* is an end view of the sled.

Figure 5B:
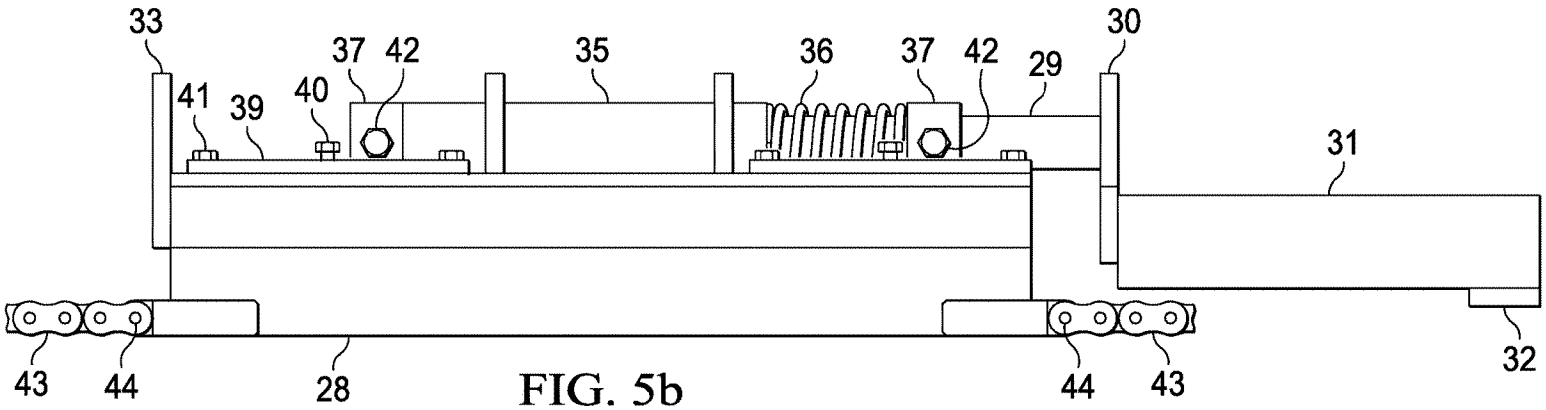

FIG. 5*b* is a side view of the sled.

Figure 5C:
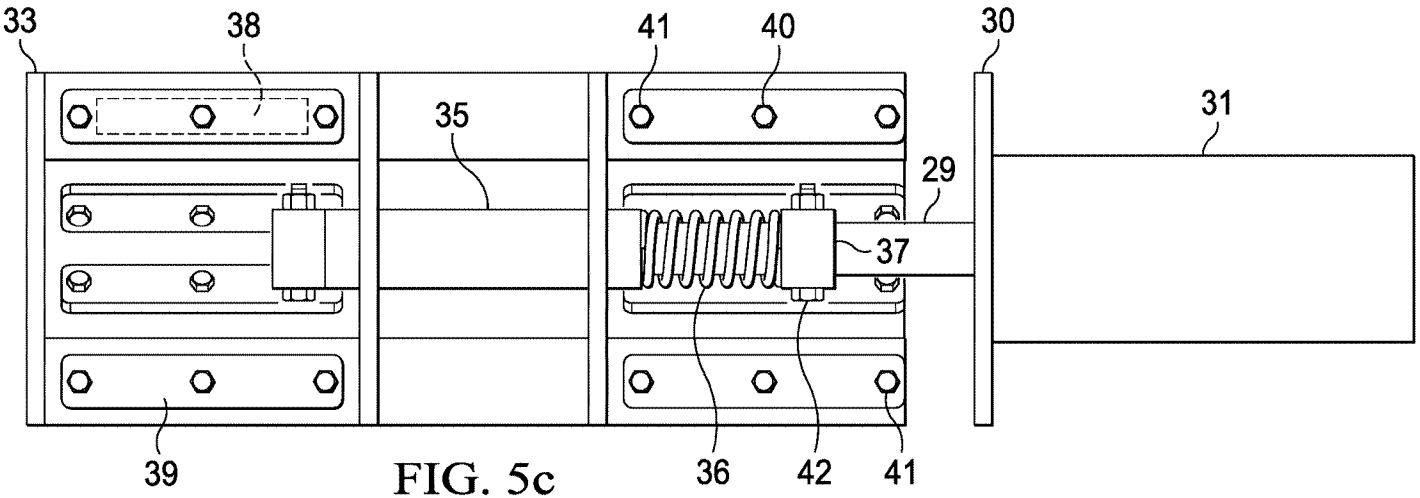

FIG. 5*c* is a top view of the sled.

Figure 6:
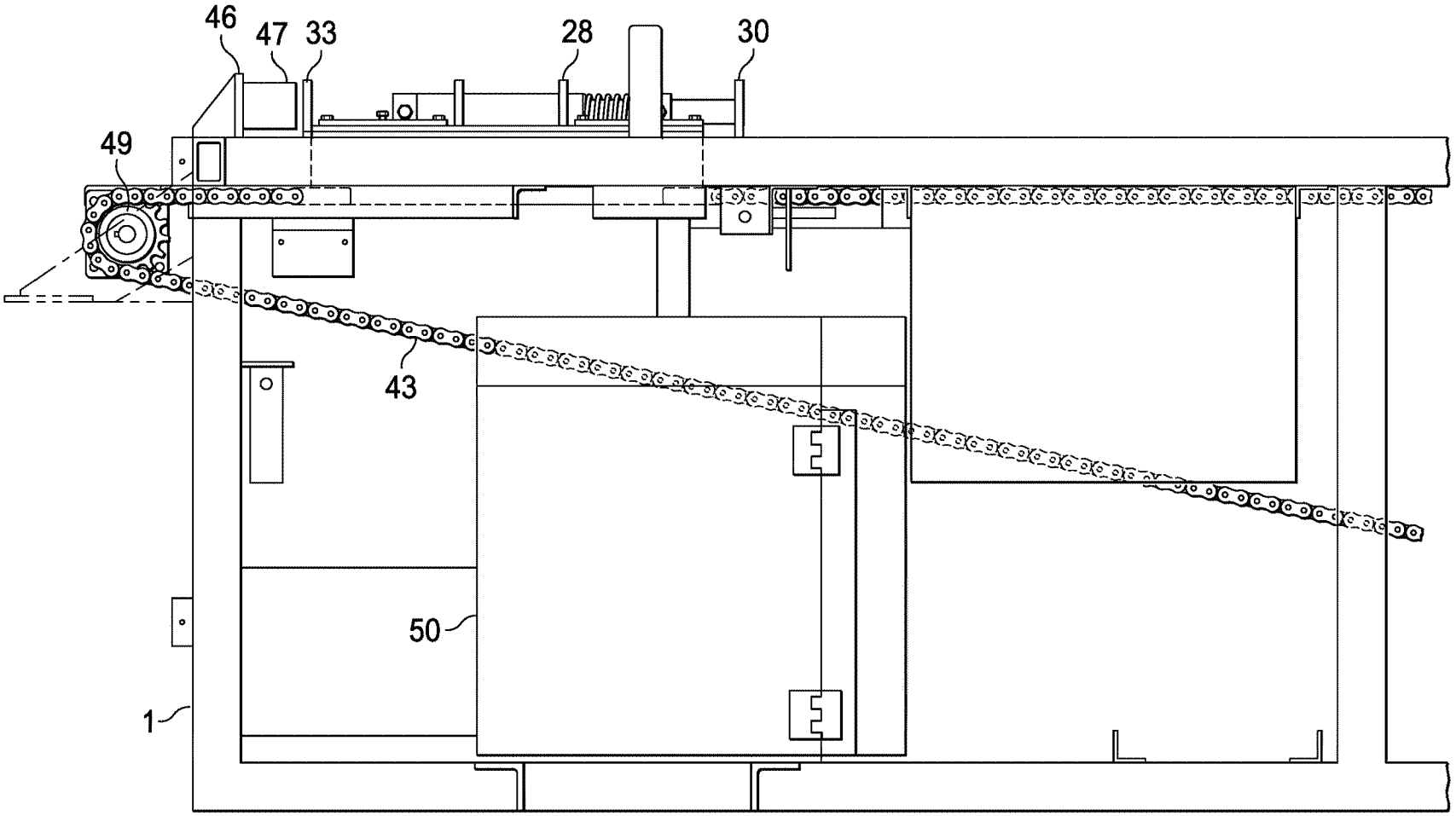

FIG. 6 is a side view of the sled.

Figure 7B:
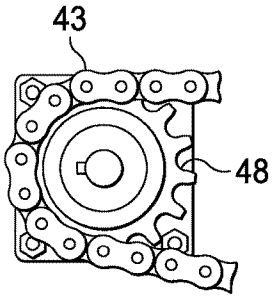
Figure 7A:
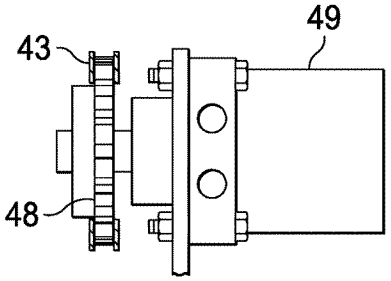

FIG. 7*a* is a top view of the sled chain drive.

FIG. 7*b* is an end view of the sled chain drive.

Figure 8:
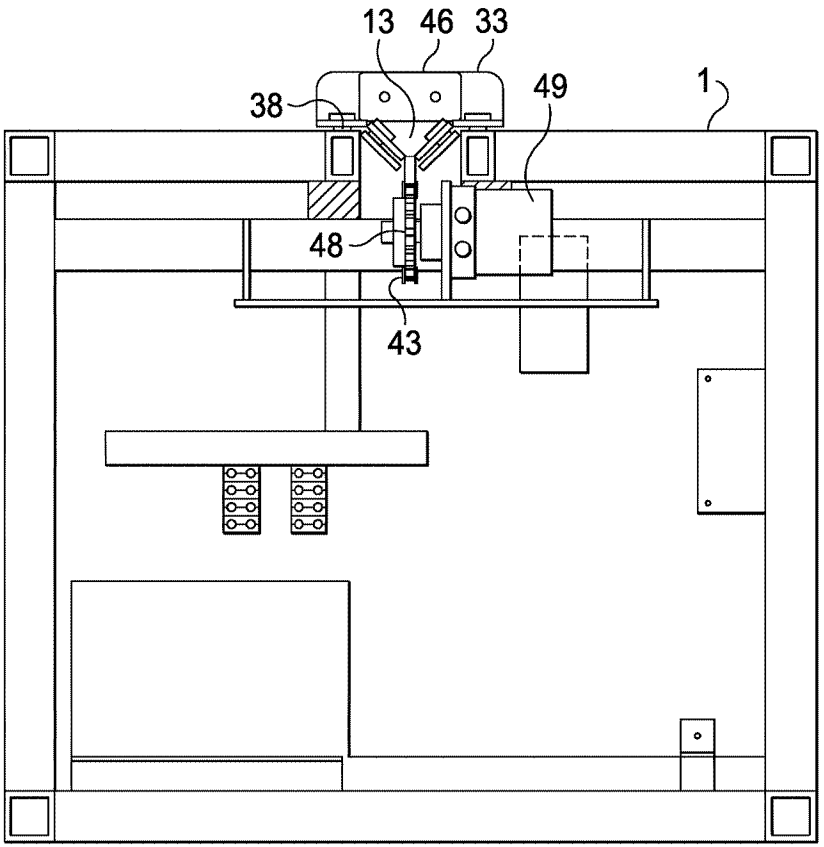

FIG. 8 is an end view of the sled drive motor.

Figure 9B:
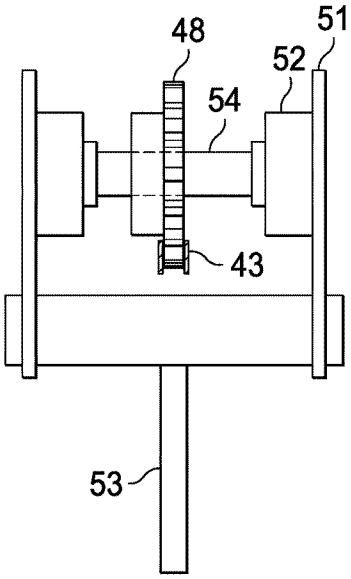
Figure 9A:
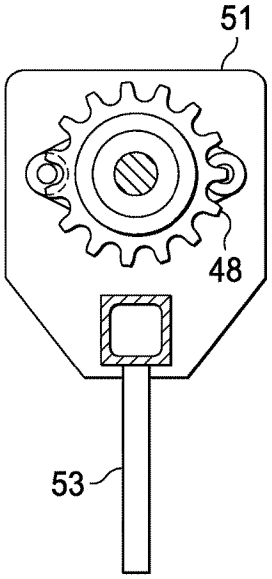

FIG. 9*a* is an end view of the chain idler.

FIG. 9*b* is a side view of the chain idler.

Figure 10A:
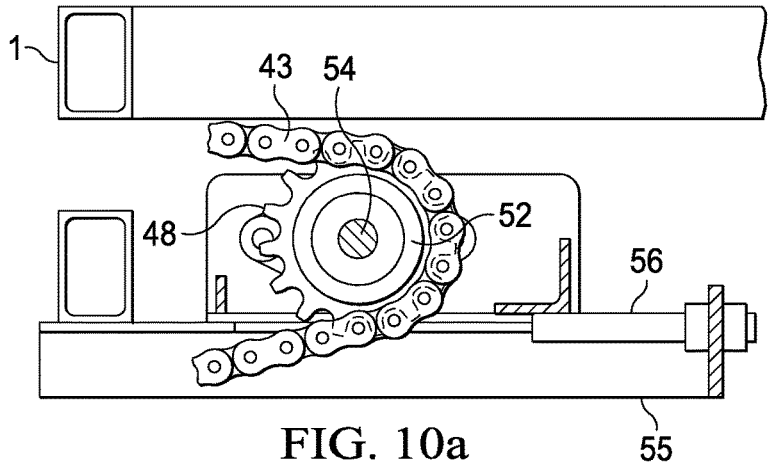

FIG. 10*a* is a side view of the sled drive chain tensioner.

Figure 10B:
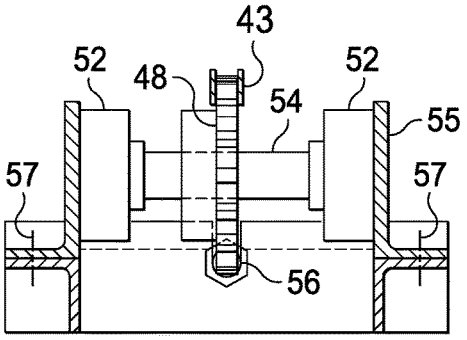

FIG. 10*b* is an end view of the sled drive chain tensioner.

Figure 10C:
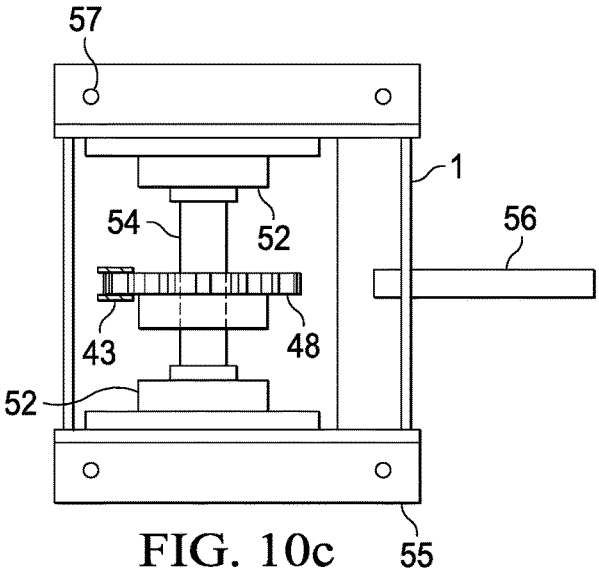

FIG. 10*c* is a top view of the sled drive chain tensioner.

Figure 11:
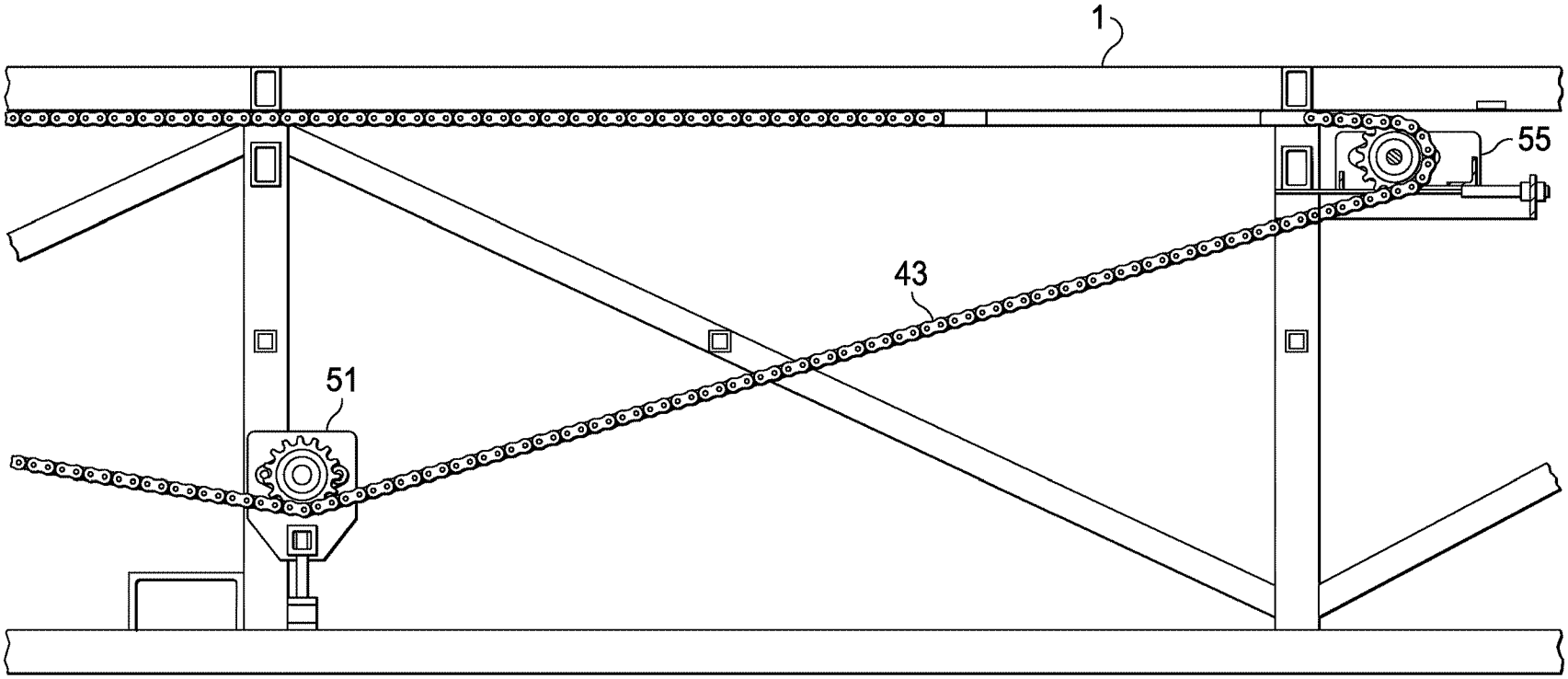

FIG. 11 is a side view of the chain idler and sled drive tensioner.

Figure 12A:
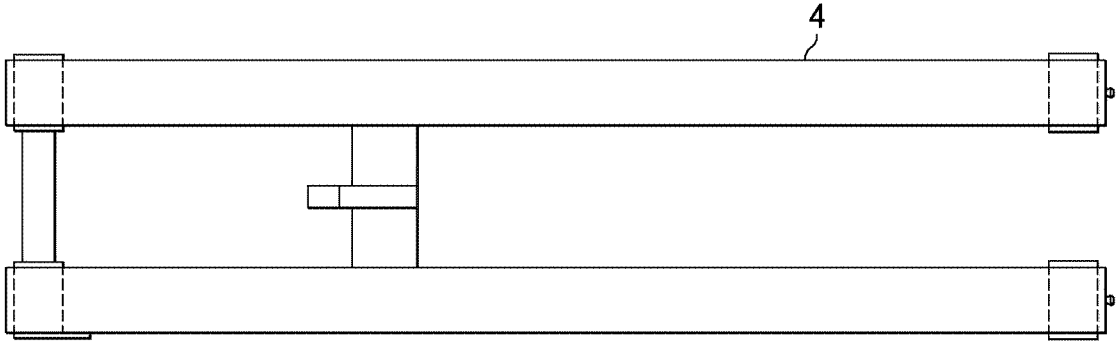

FIG. 12*a* is a top view of the boom.

Figure 12B:
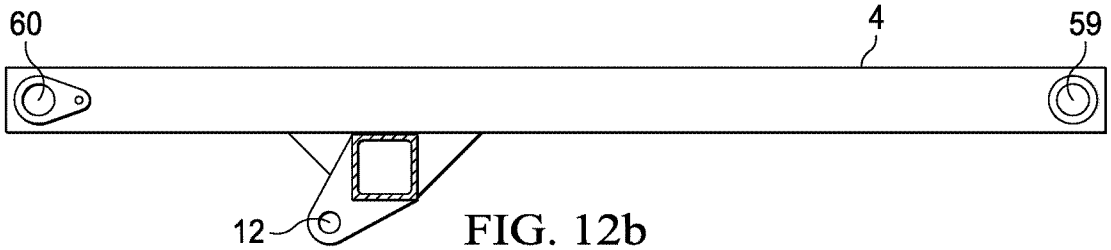

FIG. 12*b* is a side view of the boom.

Figure 12C:
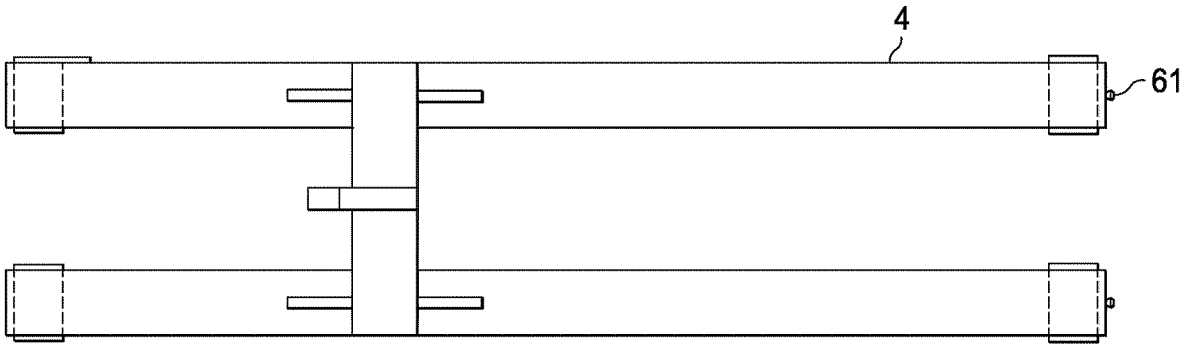

FIG. 12*c* is a bottom view of the boom

Figure 13A:
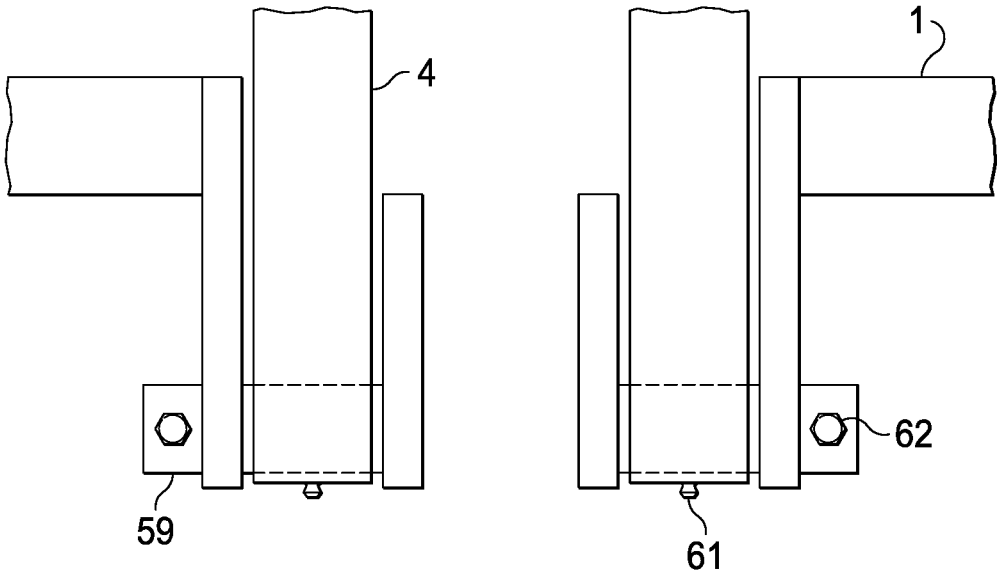

FIG. 13*a* is a top view of the boom pivot.

Figure 13B:
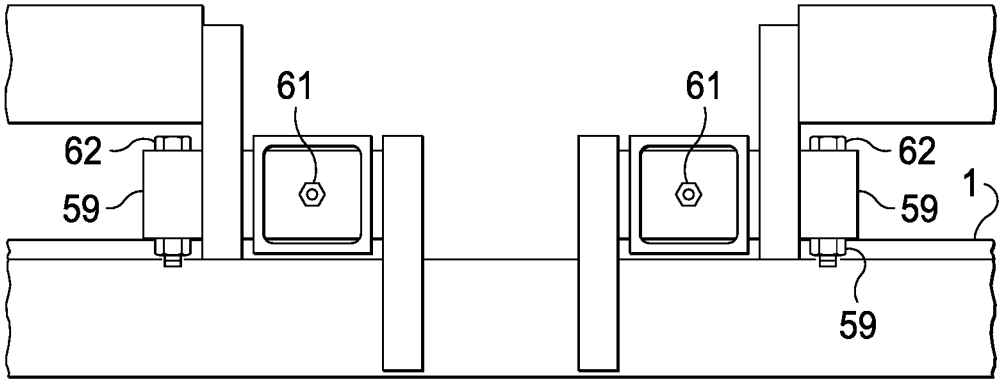

FIG. 13*b* is an end view of the boom pivot.

Figure 14A:
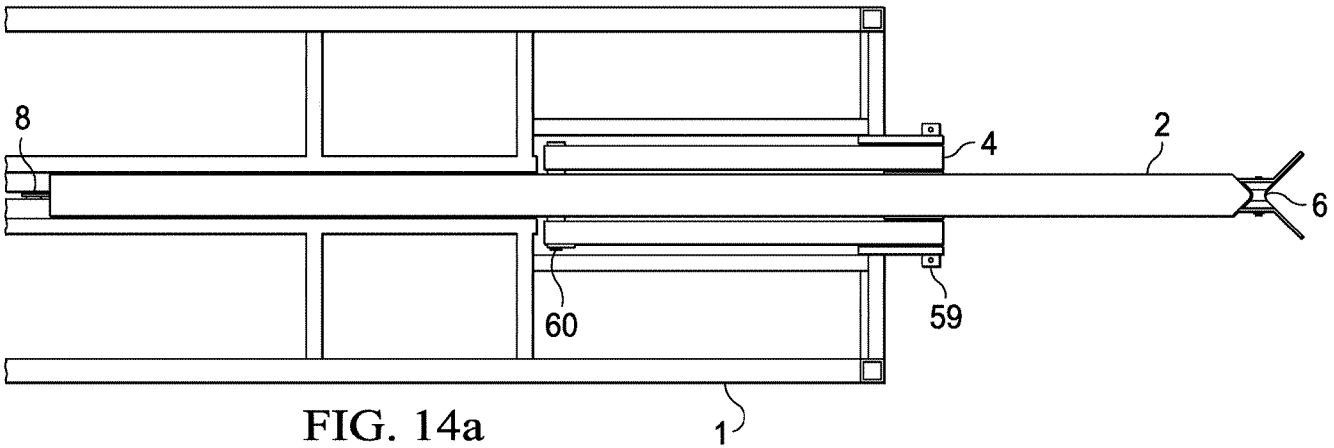

FIG. 14*a* is a top view of the lift arm.

Figure 14B:
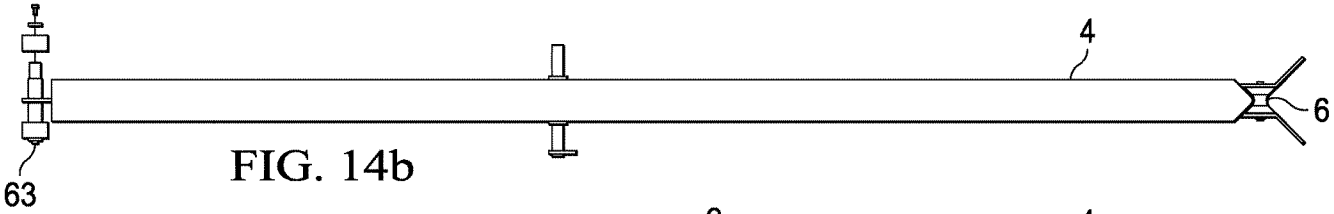

FIG. 14*b* is a top view of the lift arm.

Figure 14C:
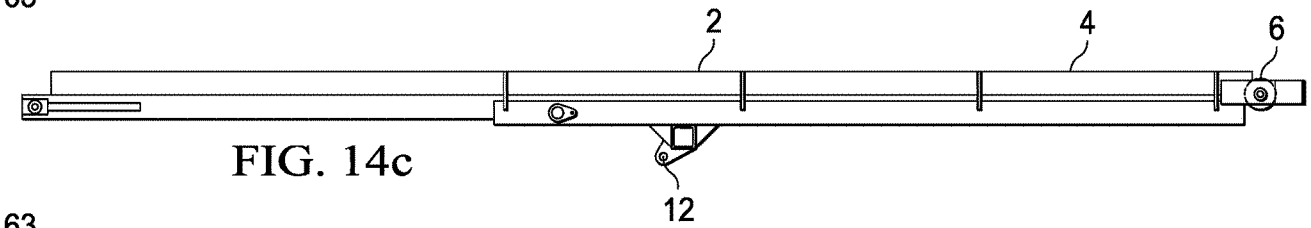

FIG. 14*c* is a side view of the lift arm.

Figure 14D:
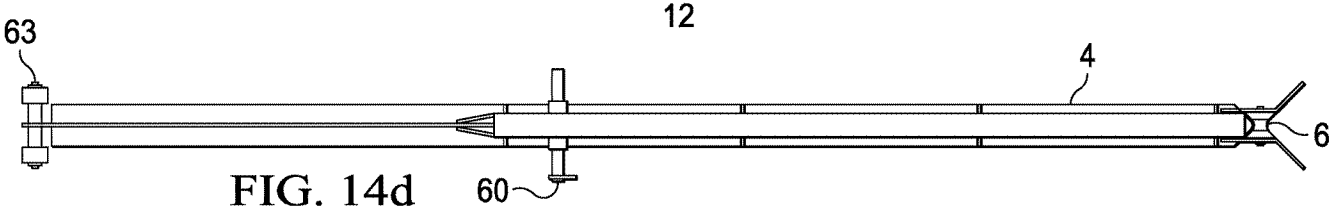

FIG. 14*d* is a bottom view of the lift arm.

Figure 15:
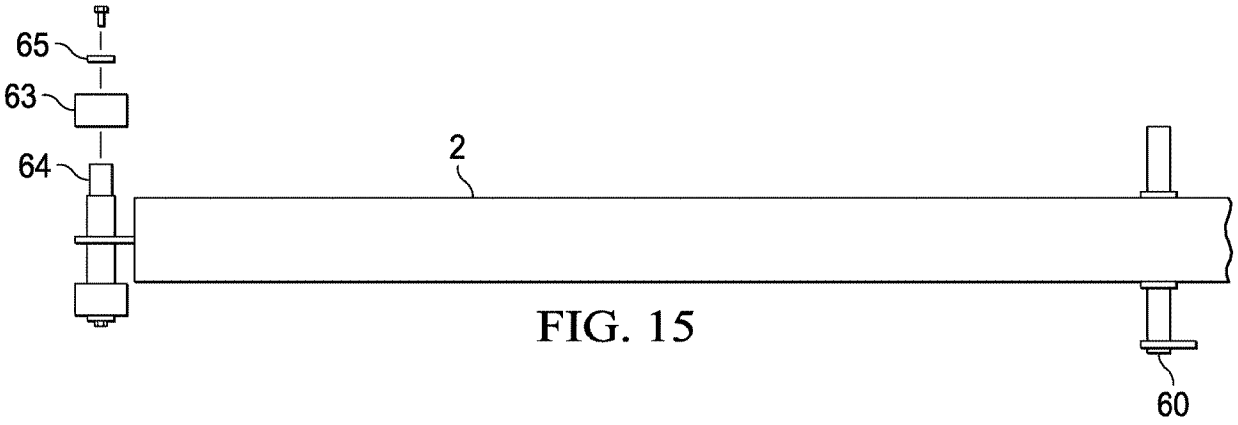

FIG. 15 is a partial top view of the lift arm.

Figure 16A:
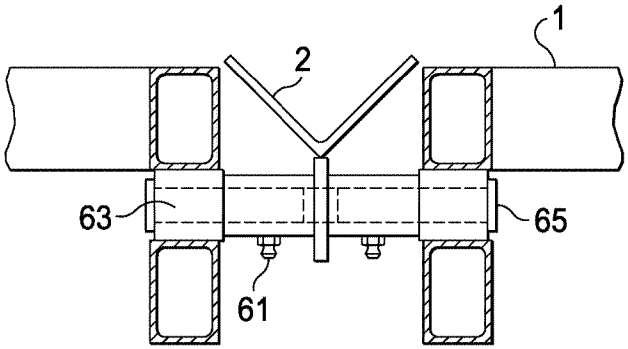

FIG. 16*a* is an end view of the lift arm slide

Figure 16B:
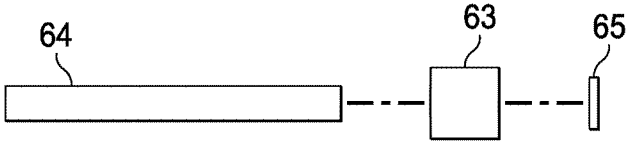

FIG. 16*b* is a view of the lift arm slide shaft.

Figure 17A:
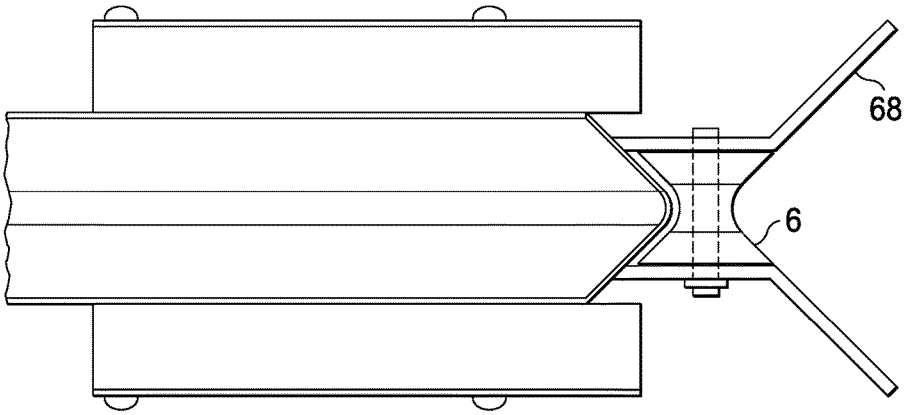

FIG. 17*a* is a top view of the Vee roller.

Figure 17B:
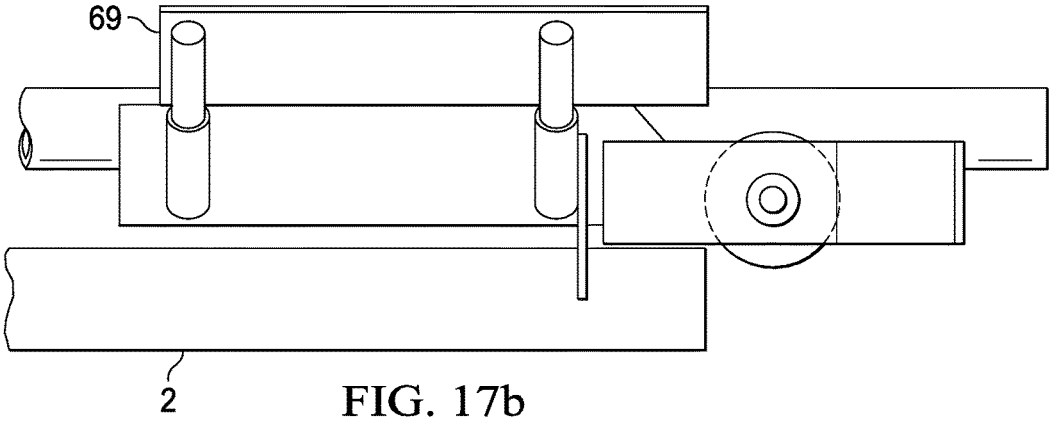

FIG. 17*b* is a side view of the Vee roller.

Figure 17C:
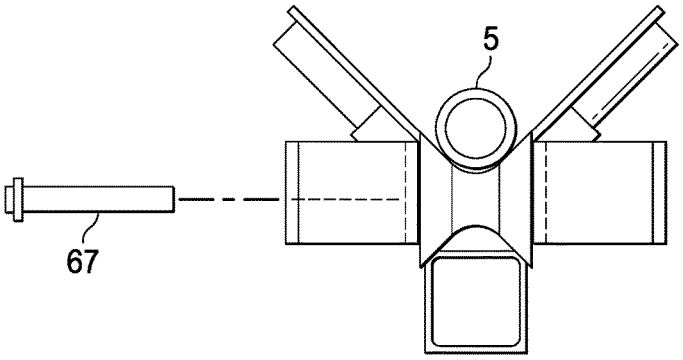

FIG. 17*c* is an end view of the Vee roller.

Figure 18A:
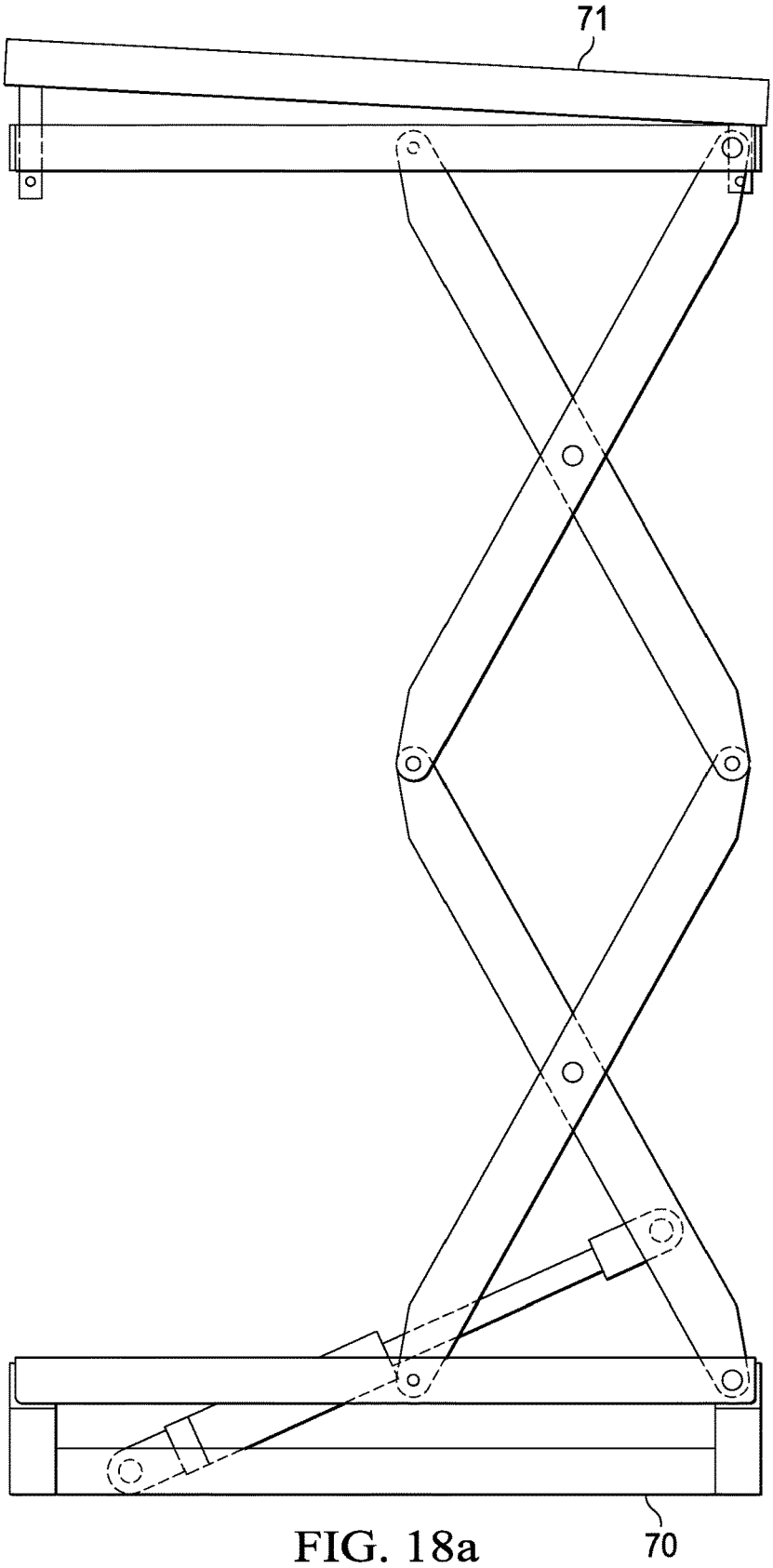

FIG. 18*a* is a view of the scissor lift extended.

Figure 18B:
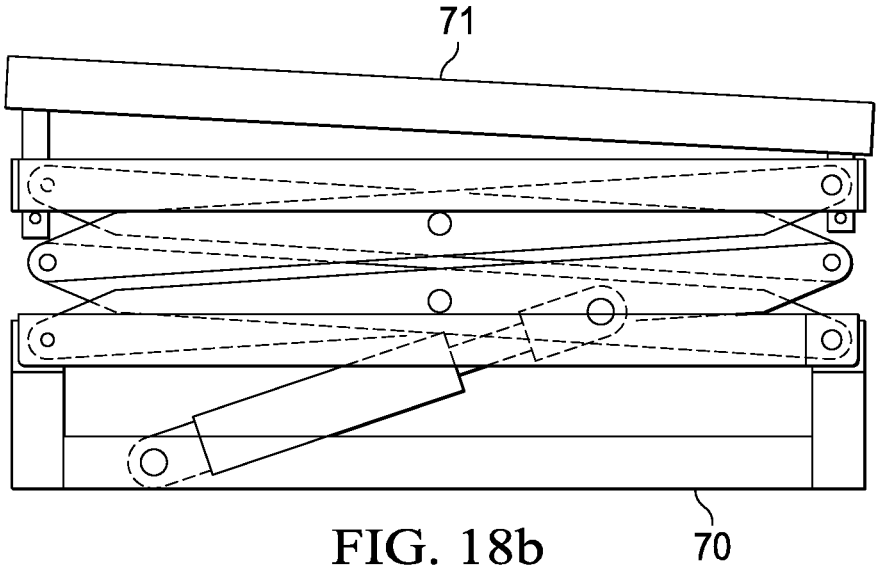

FIG. 18*b* is a view of the scissor lift retracted.

Figure 19A:
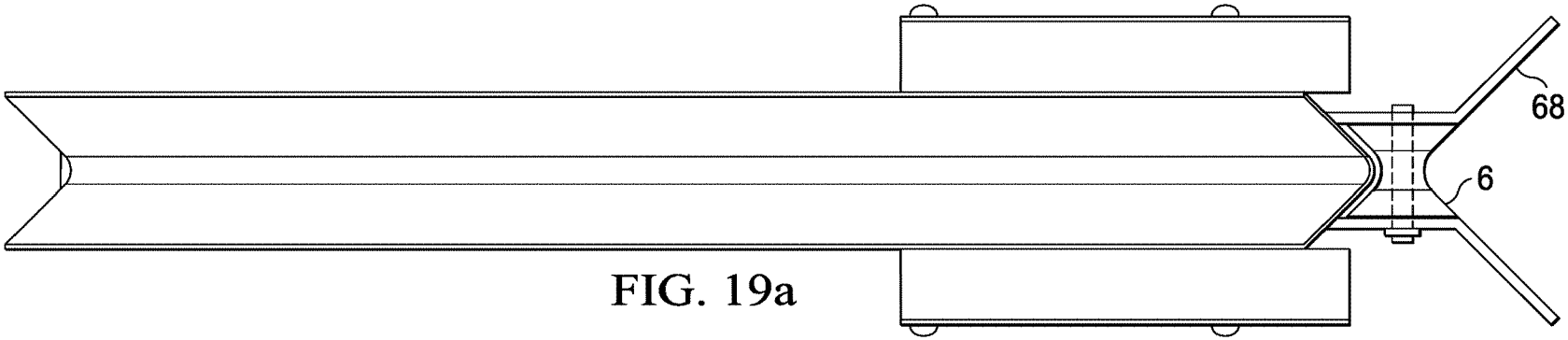

FIG. 19*a* is a top view of the lift arm removable extension.

Figure 19B:
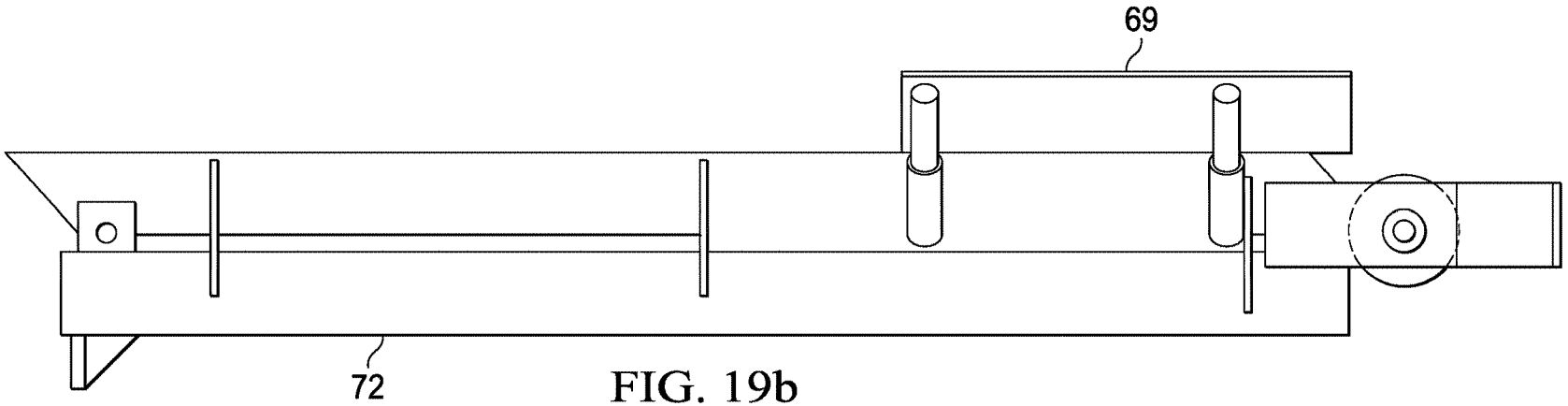

FIG. 19*b* is a side view of the lift arm removable extension.

DETAILED DESCRIPTION OF THE INVENTION

The invention described herein is a self contained/self powered hydraulic catwalk for use in oilfield drilling applications. Pipe is moved from the storage area to the trough by a plurality of pipe indexers located on the side of the frame of the self contained/self powered hydraulic catwalk. In a preferred embodiment, a set of two pipe indexers is positioned on each side of the catwalk frame to permit loading of the trough with pipe from either side. Pipe may be moved from the storage area and placed on the pipe indexers either mechanically or manually. Optionally, extensions may be connected to the pipe indexers that operate as a pipe holding device to prevent pipe from rolling under the indexer arms during operation. Pipe is unloaded from the trough of the self contained/self powered hydraulic catwalk by a set of at least two pipe kickers which are configured to push the pipe out of the trough on either side of the self contained/self powered hydraulic catwalk at the direction of the operator. Both the pipe kickers and pipe indexers are hydraulically powered. Optionally, removable Indexer extensions may be used to pickup and lower pipe at various heights. The kicker also pivots in such a way to push pipe beyond the Vee section of the trough.

The hydraulically powered lifting arm and boom raises the pipe to the drill rig floor where it may be attached to the hoisting system of the drilling rig. The hydraulically powered sled with the shock absorbing face moves the pipe from the hydraulic catwalk to the drilling rig floor. The boom and lifting arm have a unique relationship to raise pipe to a given height and maintain approximately the same distance from the end of the lift arm to the rig when raised or lowered. When the boom raises the lift arm, the lift arm is free to slide (move toward the rig platform) instead of pivoting from a fixed location. This movement allows the end of the lift arm to maintain a close relationship to the rig and minimize the distance the pipe has to move to be placed on the lift arm. Additionally, the lift arm has a roller attached to the end to allow smooth movement of pipe from the hydraulic catwalk to the rig and a removable extension can be attached to the lift arm to enable the movement of pipe to additional heights. The lift arm extends outward from the end of the catwalk approximately 4 feet which allows workers to pass from the catwalk to the rig by manually raising the lift arm.

A power supply is mounted to the catwalk or optionally, power may be obtained from an external source. The power supply may be an internal combustion engine such as a diesel powered engine, electrical motor or other type of power source. The power supply provides power to operate all of the hydraulic functions of the device. The pipe indexers, pipe kickers, lifting arm, roll offs and all other components of the self contained/self powered hydraulic catwalk are hydraulically operated. This self contained/self powered hydraulic catwalk may be operated remotely or from a central station.

When the self contained/self powered hydraulic catwalk is in position at the job site, the power supply is activated, the pipe indexers are extended and the pipe is rolled manually or mechanically from the storage site onto the pipe indexers. The hydraulically powered pipe indexers fold inward and the pipe rolls into the trough. The operator raises the lifting arm to raise the pipe to the desired level. The hydraulically powered sled with a shock absorbing push face moves the pipe toward the drill rig floor where it is attached to the hoisting system of the drilling rig. The pipe is pulled off of the lifting arm by the hoisting system of the drilling rig. When the end of the pipe leaves the lifting arm, it swings gently toward the drilling platform where it is manually moved into position for attachment to another section of pipe.

When pipe is removed from the hole, the process is reversed. The pipe attached to the hoisting system of the drilling rig is disconnected from the adjacent pipe. The pipe is lowered to the lifting arm. The pipe is further lowered down the lifting arm to the Vee trough to a position to be released from the hoisting system of the drilling rig where it contacts the shock absorbing face of the hydraulically powered sled. The hydraulically powered sled is moved down the Vee trough until the pipe is positioned in the Vee of the trough for extraction. When the pipe is completely positioned in the trough and the lifting arm is completely retracted, the pipe kickers eject the pipe from the trough where it is rolled off the frame to the storage site.

When the catwalk needs additional means to move pipe from various storage heights, a hydraulically powered pipe lifting device can be used. Optionally the device will be of a scissor lift style to raise and lower pipe vertically from different platform heights when pipe has been stacked in layers. The pipe lifting device referred to as a pipe table' has a down position or collapsed position and an extended position. The extended position can pick up pipe or deliver pipe at heights greater than the catwalk. The collapsed position can pick up or deliver pipe at heights below the top level of the catwalk. The pipe table has greater flexibility than indexers with extensions to move pipe from the catwalk to pipe racks or the reverse.

Figure 1A:
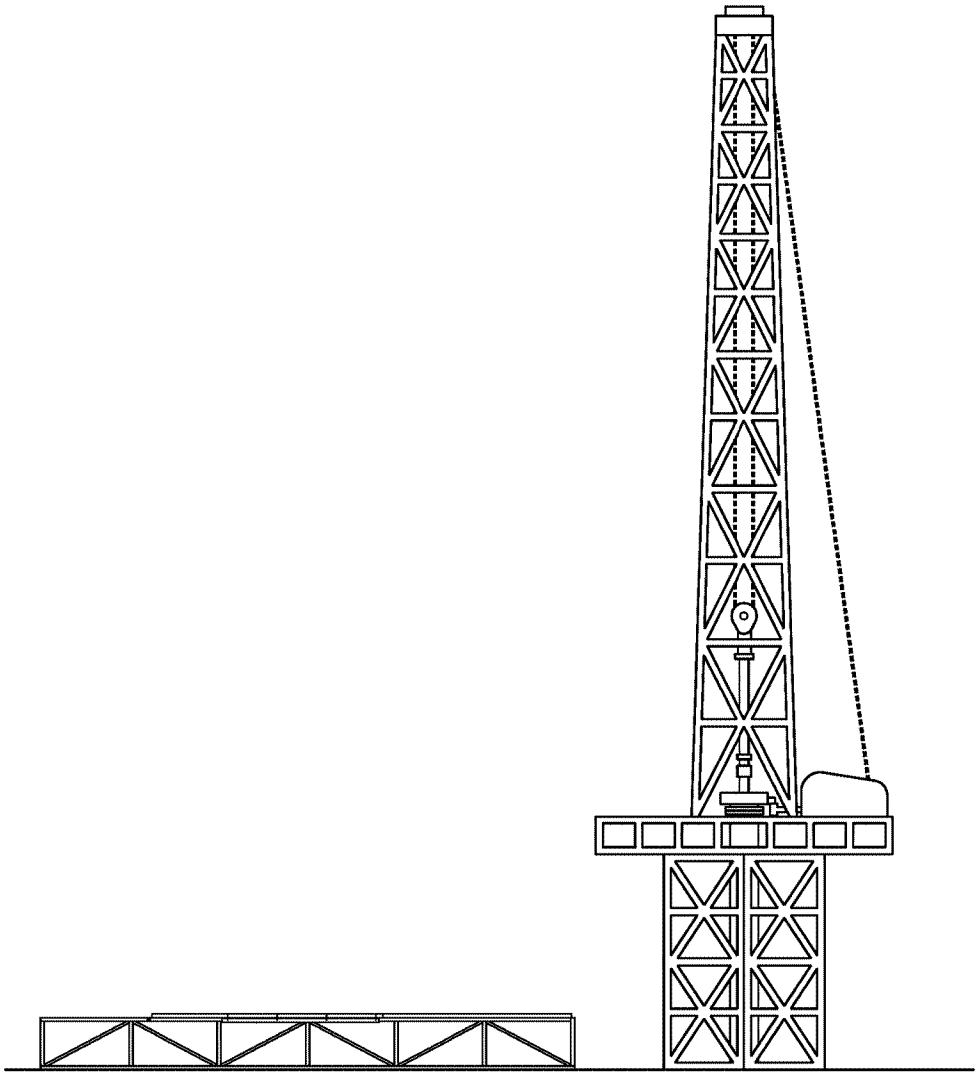
FIG. 1a (PRIOR ART)
Figure 1B:
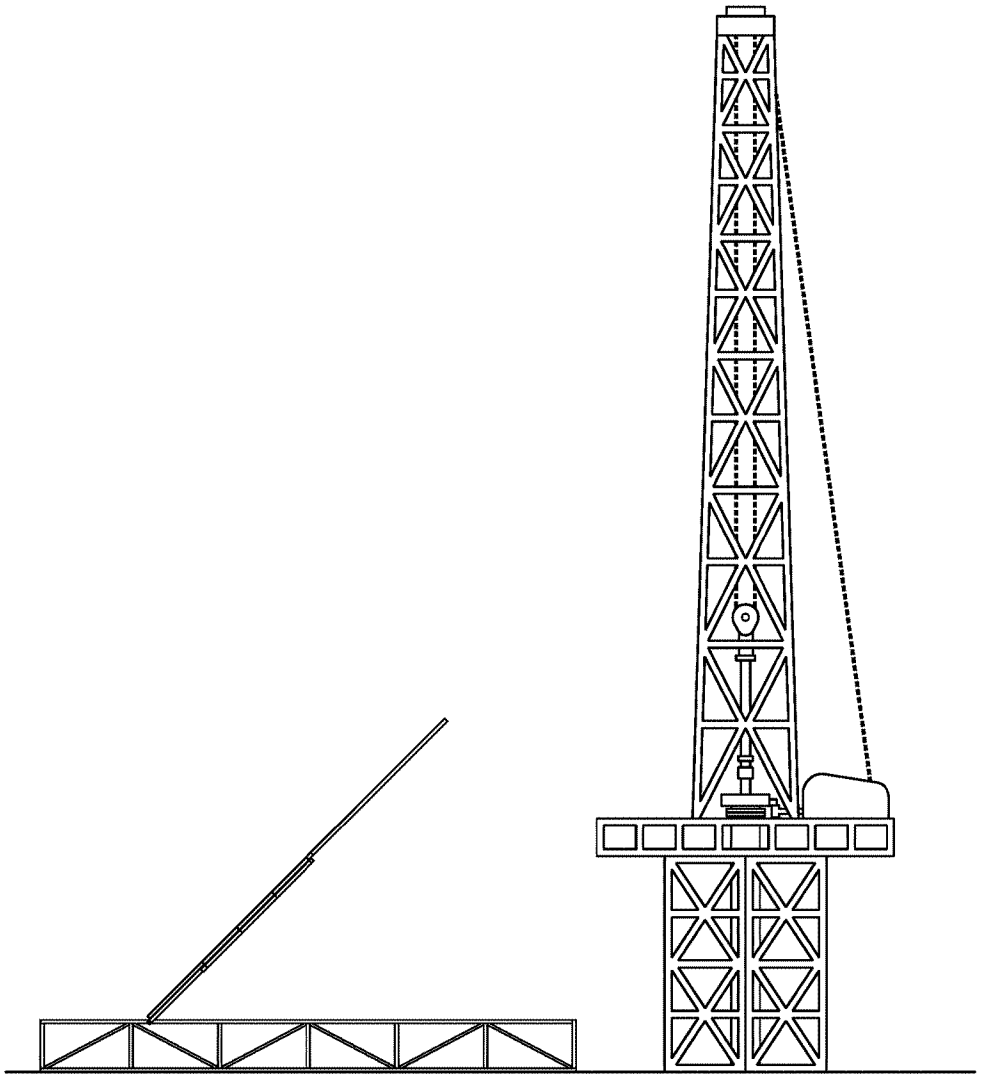
FIG. 1b (PRIOR ART)
Figure 1C:
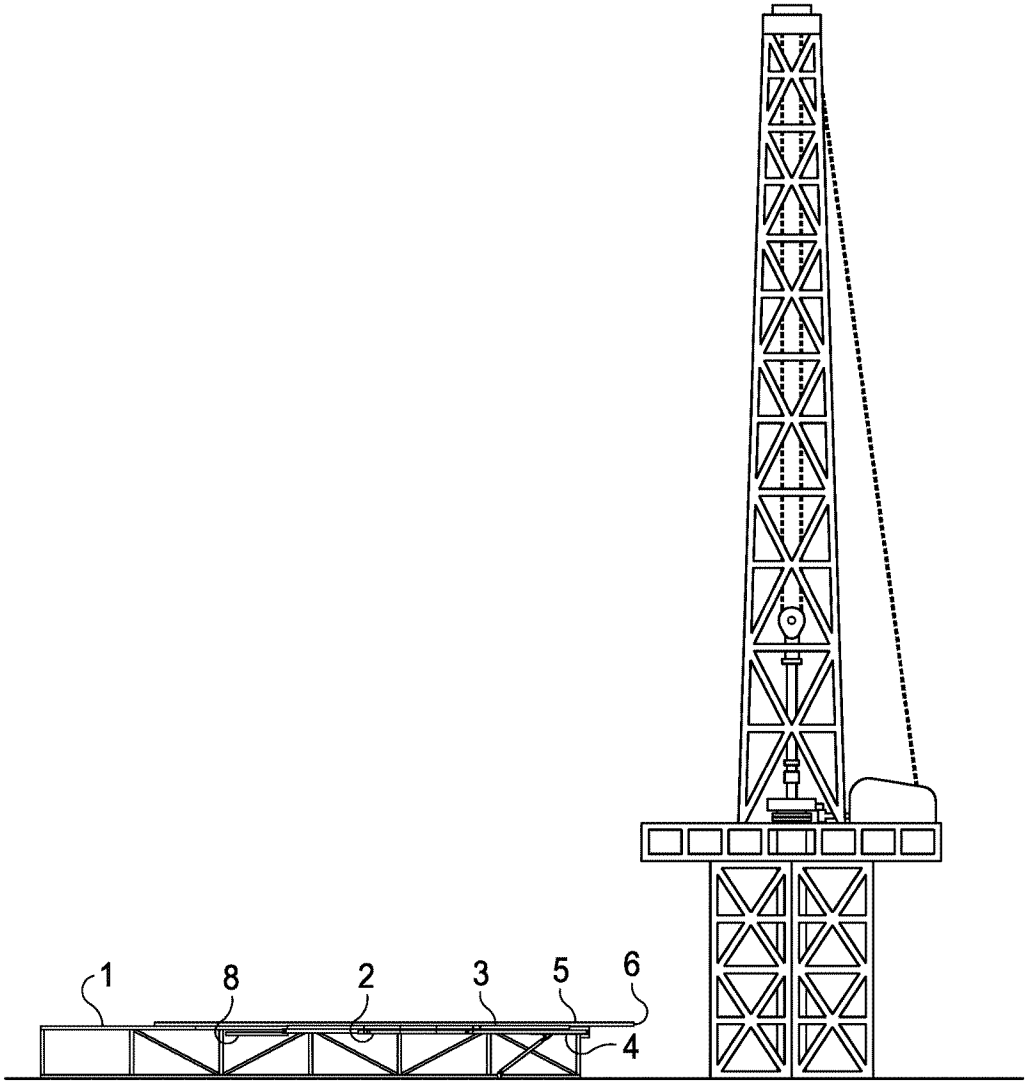
Figure 1D:
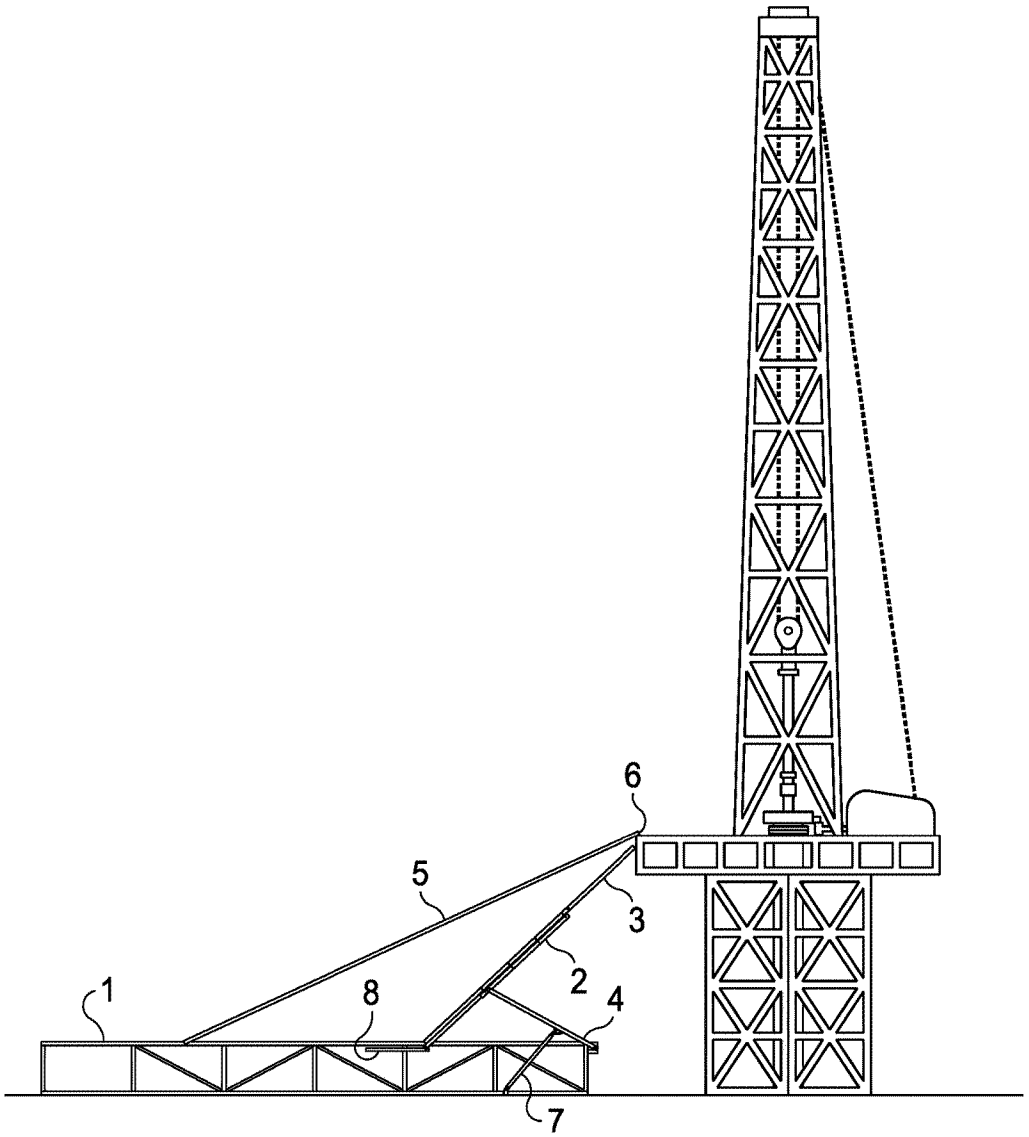
Figure 1E:
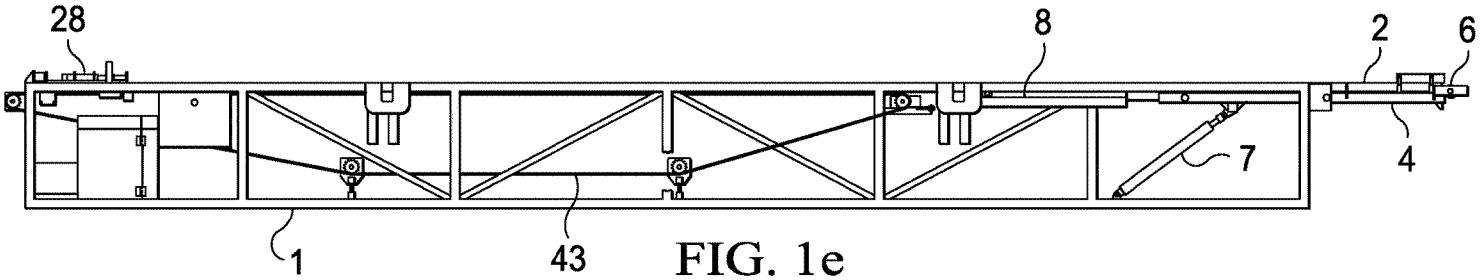
Figure 1F:
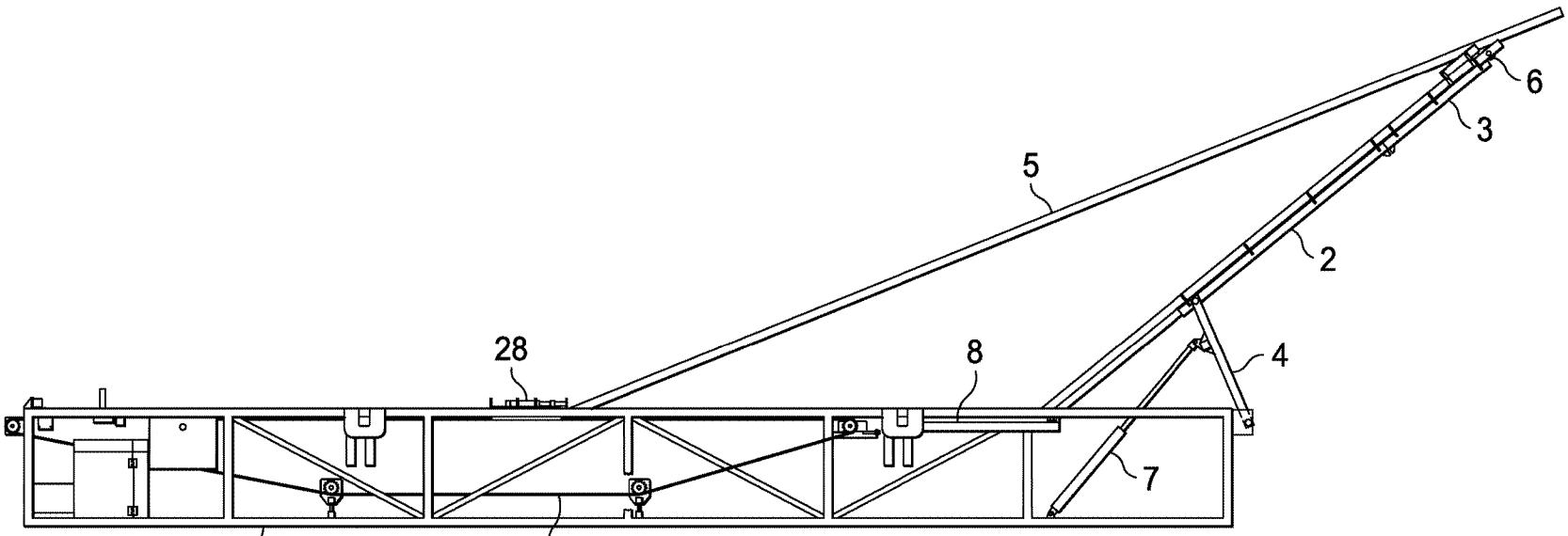

As shown in FIG. 1*c*, the self contained/self powered hydraulic catwalk is moved into position next to a drilling rig. The self contained/self powered hydraulic catwalk consists of a frame 1 to which is attached a lifting arm 2 which raises pipe 5 to the required level. Optionally a removable extension 3 may be attached to the lift arm 2 to enable the elevation of pipe 5 to greater heights. The lifting arm 2 is elevated by a hydraulic boom 4. As the lifting arm 2 is elevated a lift arm slide 8 attached to the base of the lifting arm 2 "slides forward" moving the base of the lifting arm 2 toward the drill rig. As shown in FIG. 1*d*, the lifting arm 2 has been raised by the hydraulic cylinder 7 of the boom 4 to the level of the drill floor. As the lifting arm 2 is elevated, the base of the lift arm 2 attached to the lift arm slide 8 has moved toward the drill platform and the distal end of the lift arm 2 is kept in close proximity to the drill rig. The pipe 5 can then be easily pushed over the Vee roller 6 onto the drill platform. Optionally, and as shown in FIG. 1*d*, a removable extension 3 has been attached to the distal end of the lift arm 2 to permit pipe 5 to be elevated to a higher level. For clarity and to show greater detail the self contained/self powered hydraulic catwalk is shown in the horizontal position in FIG. 1*e* and in the elevated position in FIG. 1*f*. In FIG. 1*e* the orientation of some of the components of the self contained/self powered hydraulic catwalk are shown in the horizontal position. At the proximal end of the catwalk is the pipe pushing sled 28 which pushes the pipe 5 through the Vee trough and to the lift arm 2. The pipe pushing sled 28 is moved by a chain 43 attached to the power source. The lift arm 2 is raised by a boom 4 attached to a hydraulic cylinder 7. The lift arm 2 is attached to the lift arm slide 8. The pipe 5 rolls over the Vee roller 6 located at the distal end of the lift arm 2 and permits the pipe 5 to move smoothly onto the drill rig. All of these components are attached to the frame 1. FIG. 1*f* shows that the lift arm 2 has been elevated by the boom 4 connected to the hydraulic cylinder 7. The lift arm slider 8 attached to the base of the lift arm 2 has moved forward toward the drill rig and maintains the distal end of the lift arm 2 is close proximity to the drill rig. The pipe pushing sled 28 powered by the chain 43 pushes the pipe 5 up the lift arm 2 to the Vee roller 6 where it can easily be transferred to the drill rig.

Figure 2:
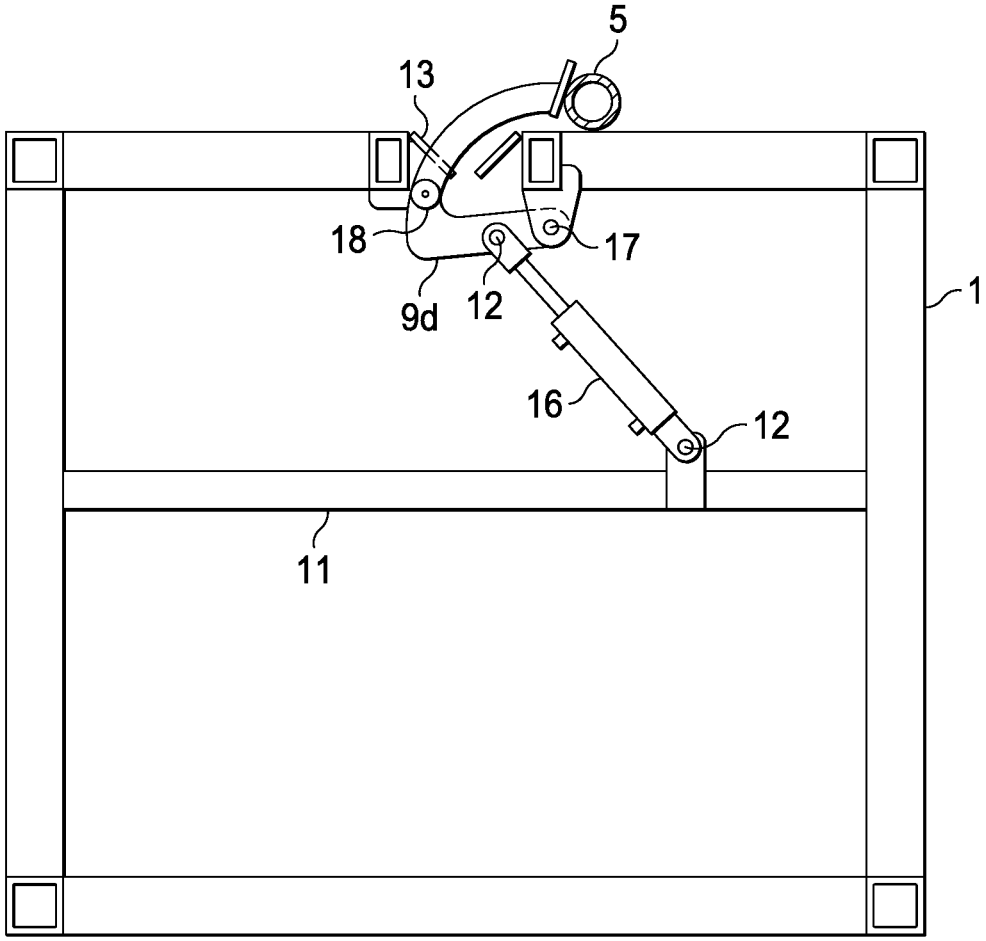
FIG. 2 is an end view of the catwalk showing the kicker mechanism.

Another component of the self contained/self powered hydraulic catwalk is a mechanism for removing a pipe 5 from the Vee through 13 and moving the pipe 5 to a storage rack. As shown in FIG. 2. a kicker 9*d* is connected to a kicker hydraulic cylinder 16 with a hydraulic cylinder pin 12. The kicker hydraulic cylinder 16 is attached to the catwalk frame 1 by a hydraulic cylinder mount 11 by way of another hydraulic cylinder pin 12. When the hydraulic cylinder 16 is engaged the kicker 9*d* pivots about a kicker pivot 17 and pushes the pipe 5 out of the Vee trough 13 guided by a kicker guide 18. There may be a plurality of kickers 9*d* spaced at intervals along the longitudinal axis of the Vee trough 13.

Figure 3:
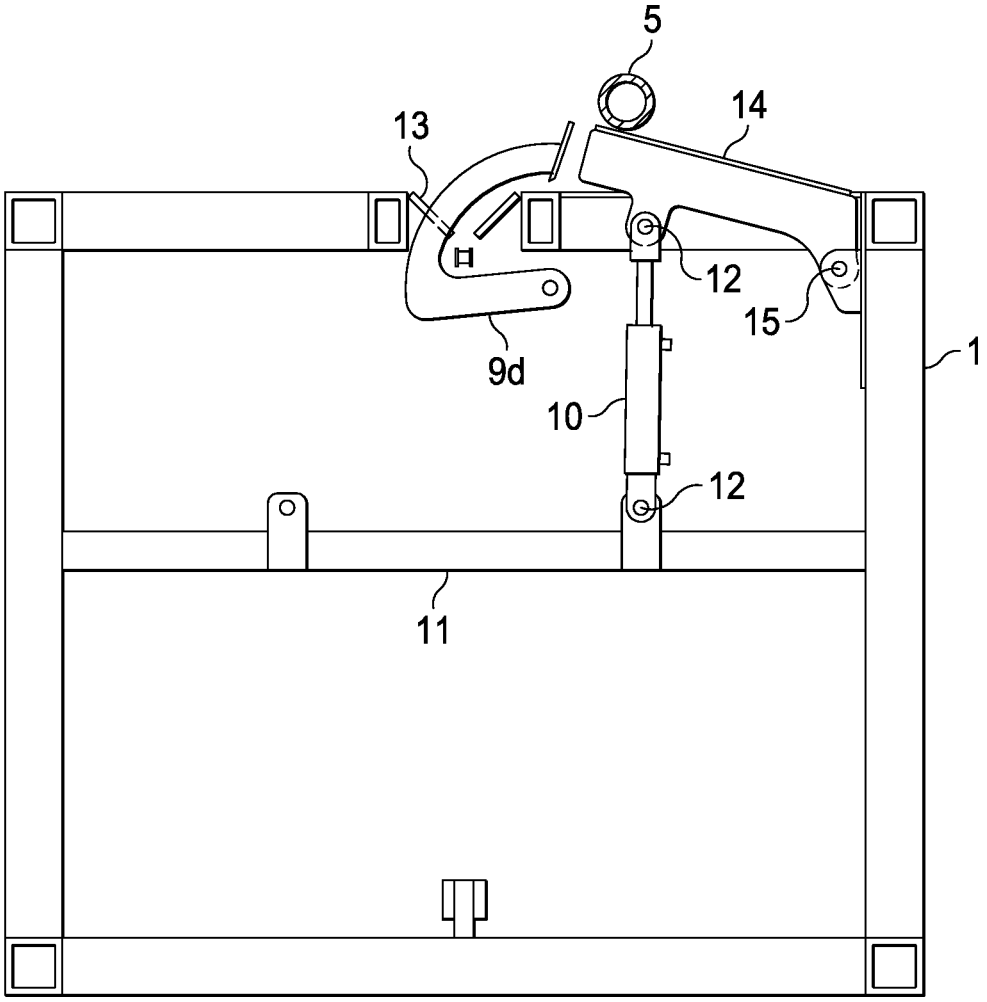
FIG. 3 is an end view of the catwalk showing the roll off mechanism.

Once the kicker 9*d* has pushed the pipe 5 out of the Vee trough 13, the pipe 5 is positioned on a roll off 14 as shown in FIG. 3. As shown, the roll off 14 is in the elevated position having been raised by the roll off hydraulic cylinder 10. The roll off hydraulic cylinder 10 is attached to the catwalk frame 1 through a hydraulic cylinder mount 11 and connected to the hydraulic cylinder mount 11 by a hydraulic cylinder pin 12. As the roll off hydraulic cylinder 10 is engaged, the roll off 14 pivots about a roll off pivot pin 15 elevating the roll off 14 causing the pipe 5 to roll off the catwalk to a storage carriage by gravity. A plurality of roll offs 14 may spaced at intervals along the longitudinal axis of the Vee trough 13.

As shown in FIG. 4*a*, a kicker 9*p* can also be oriented to push pipe 5 out of the Vee trough 13 in the opposite direction as that of the kicker 9*d* described above. The kicker 9*p* is connected to a kicker hydraulic cylinder 16 by a hydraulic cylinder pin 12. The kicker hydraulic cylinder 16 is attached to the catwalk frame 1 by a hydraulic cylinder mount 11. The kicker hydraulic cylinder 16 is secured to the hydraulic cylinder mount 11 by a hydraulic cylinder pin 12. As the kicker hydraulic cylinder 16 is engaged, the kicker 9*p* is raised pushing the pipe 5 from the Vee trough 13. For clarity the kicker guide 18 and kicker stop 19 are shown in FIG. 4*b*. A plurality of kickers 9*p* may be positioned along the longitudinal axis of the Vee trough 13. As in FIG. 4*a*, Pipe 5 may be moved onto the self contained/self powered catwalk by an indexer 20. Pipe 5 is moved onto the indexer 20 and held in place by a pipe cradle 21 and an adjustable pipe locator stop 23. The adjustable pipe locator stop 23 can swing left/right or forwards/backwards on the frame 1. A pipe stop 22 located on the indexer 20 prevents the "next in line" pipe 5 from rolling underneath the indexer 20 and fouling the indexer 20 mechanism. The indexer 20 is elevated by an indexer hydraulic cylinder 24 attached to the indexer 20 by a hydraulic cylinder pin 12 and pivots about the indexer pivot pin 25. The indexer hydraulic cylinder 24 is attached to the self contained/self powered hydraulic catwalk by a hydraulic cylinder mount 11 and held in place by a hydraulic cylinder pin 12. Attached to the adjustable pipe locator stop 23 is a pipe locator receiving tube 26 is a shaft that slides in a receiving tube and secured with a wing bolt 27. As the indexer 20 is raised by the indexer hydraulic cylinder 24, a pipe 5 can roll by gravity into the Vee trough 13 for delivery to the drill rig floor. A plurality of indexers 20 may be positioned at intervals along the longitudinal axis of the Vee trough 13. The indexers 20 may also be oriented to retrieve pipe 5 from the side opposite that described above.

The pipe 5 positioned in the Vee trough 13 is moved through the Vee trough 13 to the drill rig floor by a pipe pushing sled 28. As shown in FIGS. 5*a*, 5*b* and 5*c*, the pipe pushing sled 28, has a push face shaft 29 attached to a sled push face spring 36 by sled shaft retention rings 37 secured by retention ring bolt 42. The purpose of the sled shaft retention rings 37 are to hold the spring 36 in position. The push face shaft 29 is connected to the push face 30 which connects to the glove 31 into which the pipe 5 is cradled. A sled extend stop bumper 32 attached to the glove 31 stops the pipe pushing sled 28 at a forward position using the spring 36 to relieve stress on the drive chain 43. The push face shaft 29 is partially housed within a push face shaft sleeve 35 and held in place by a retention ring bolt 42. Attached to the rear of the pipe pushing sled 28 is a sled retract stop bumper 33 which prevents the pipe pushing sled 28 from retracting too far rearward. The sled frame 34 extends through the Vee trough 13 to connect to the sled drive chain 43 in which the individual links of the sled drive chain are connected by sled drive chain attach pins 44. The sled drive chain 43 is guided by a sled drive chain guide block 45. The sled moves on a sled bearing 38 which is housed in the sled frame 34 and retained by the sled bearing cap 39 held in place by bearing cap bolts 41. The sled bearings 38 are held in place by bearing retainer bolts 40. A sled bumper 47 is attached to a sled retract bumper mount 46 to cushion the sled 28 as it returns to the rearward position as shown in FIG. 6.

The power supply 50 powering the self contained/self powered catwalk is shown in FIG. 6. The power supply 50 may be a gas or diesel engine or some other reliable source of power. The power supply 50 is connected to the sled drive chain sprocket 48 which when activated rotates and moves the sled drive chain 43 which in turn moves the pipe pushing sled 28 forward or backward. The sled drive motor 49 which rotates the sled drive chain sprocket 48 which in turn moves the sled drive chain 43 is shown in FIGS. 7*a*, 7*b* and 8. In FIG. 6 the drive motor 49 is attached to the catwalk frame 1 and moves the pipe pushing sled 28. From this perspective the sled retract stop bumper 33, retract bumper stop 46 and rubber bumper 47 are also shown. The pipe pushing sled 28 moves along on sled bearings 38. FIGS. 9*a*, 9*b* show perspectives of the chain idlers 51. The sled drive chain sprocket 48 on shaft 54 rotates through bearings 52. The chain idlers 51 can be adjusted to change tension on the sled drive chain 43 through bolt 53. In FIGS. 10*a*, 10*b*, and 10*c*, the sled drive chain 43 can be adjusted so as to tighten or loosen the sled drive chain 43 by an adjustment bolt 56. The sled drive chain tensioner 55 is held in place by locking bolts 57 located on either side of the bearings 52. As shown in FIG. 11 the sled drive chain 43 extends from the chain drive motor 49 to the sled drive chain tensioner 55 of the self contained/self powered hydraulic catwalk. The tension of the sled drive chain 43 can be adjusted by a sled drive chain tensioner 55. The sled drive chain tensioner 55 may be adjusted so as to tighten or loosen the sled drive chain 43.

As shown in FIGS. 12*a*, 12*b*, and 12*c*, and as previously shown, the lift arm 2 is raised and lowered by a hydraulic boom 4 which is attached to the frame 1 by a boom pivot pin 59. The boom 4 is attached to the lift arm 2 by a lift arm king pin 60. The boom 4 is attached to a hydraulic cylinder 7 by a hydraulic cylinder pin 12. The lift arm 2 is Vee shaped like the Vee trough 13 and when in the horizontal position the lift arm 2 is nested within the Vee trough 13. FIGS. 13*a* and 13*b* are a top view and end view of the boom 4 demonstrating the relationship of the boom pivot pin 59 and the boom pivot pin lock bolt 62. For maintenance and optimal performance the boom 4 may be lubricated through a grease zerk 61. FIG. 14*a* shows the self contained/self powered hydraulic catwalk lift arm 2 connected at the lift arm king pin 60. As the boom moves upward or downward it rotates about the boom pivot pin 59. The lift arm 2 is connected at its base to the lift arm slider 8 and to the lift arm king pin 60. FIGS. 14*a*, 14*b*, 14*c*, and 14*d* show the lift arm 2 which pivots about the lift arm slide bearing 63 when the lift arm 2 is raised and lowered.

FIGS. 15, 16*a* and 16*b* show the connection of the lift arm slide 8 to the base of the lift arm 2. A lift arm slide shaft 64 extends through the lift arm slide 8 and extends through a pair of lift arm slide bearings 63. The lift arm slide shaft 64 is secured to the lift arm 2 by lift arm shaft retention washers 65. The lift arm slide 8 is attached to the base of the lift arm 2 and as the distal end of the lift arm 2 is elevated the lift arm slide 8 moves the base of the lift arm 2 toward the distal end of the catwalk. For maintenance and optimal performance, the lift arm slide shaft 64 may be lubricated through grease zerks 61.

The distal end of the lift arm 2 is shown in FIGS. 17*a*, 17*b*, and 17*c*. As the pipe 5 is pushed up the lifting arm 2 by the pipe pushing sled 28 it comes into contact with a Vee roller 6 which helps move the pipe 5 up the lifting arm 2 to the drill rig floor. The Vee roller 6 is mounted to the lift arm 2 on a Vee roller mount and pipe guide 68 and secured to the Vee roller mount and pipe guide 68 by a Vee roller pivot pin 67.

Frequently, pipe is stored at a height which is above or below the top of the self contained/self powered hydraulic catwalk making it difficult and or hazardous to load the pipe onto the catwalk. As another embodiment, a scissor lift 70 which can be raised or lowered to the desired height may be used to load or off load pipe to/from the catwalk safely. As shown in FIGS. 18*a* and 18*b*, the scissor lift 70 is shown in extended and retracted mode, respectively. The scissor left 70 is operated hydraulically and may be raised or lowered to the desired height. The scissor lift 70 may also be equipped with a reversible pipe ramp 71 which enables loading/unloading of pipe from either side of the catwalk. The reversible pipe ramp 71 is sloped so that pipe rolls on or off of the scissor lift 70 by the force of gravity.

It is sometimes necessary to move pipe to unusual heights. In another embodiment, the length of the lift arm 2 may be lengthened by a removable lift arm extension 72 as shown in FIGS. 19*a* and 19*b*. Like the standard lift arm 2, the removable lift arm extension 72 comes equipped with a Vee roller 6 and Vee roller mount and pipe guide 68. Additionally, the removable lift arm extension 72 may be equipped with removable lift arm safety sides 69. The removable lift arm safety sides 69 prevent pipe from falling off of the removable lift arm extension 72.

The invention disclosed herein is an improvement over other hydraulic catwalk devices. The hydraulic catwalk disclosed herein is a mobile, self contained unit which requires no outside support equipment. The self contained/self powered hydraulic catwalk is lighter (<6000 lbs.) than other hydraulic catwalks which makes it easier and cheaper to move to the worksite. This hydraulic catwalk may easily be towed to the job site and quickly positioned at the drill rig. The self contained/self powered hydraulic catwalk can be operated remotely or from a central station located on the catwalk. Pipe can be safely and efficiently lifted to or unloaded from a rig floor at heights of 4 feet or more. The catwalk can also be fitted with hydraulic outriggers for stabilization and also to raise the catwalk to enable handling of elevated layers of pipe. Additionally, pipe is lifted to the drill floor directly by the lifting arm rather than by lifting the entire trough in which the pipe rests as in other types of hydraulic catwalks. Elimination of the requirement of lifting the trough containing the pipe reduces the weight of the self contained/self powered hydraulic catwalk and reduces the number of parts to which maintenance is needed to keep the self contained/self powered hydraulic catwalk in working order. In one embodiment of the invention disclosed herein the self contained/self powered hydraulic catwalk is 36 feet long, 4 feet wide and 42 inches tall. It may be powered by a Hatz 12 HP diesel engine with a 13 gallon diesel reservoir. In this configuration the self contained/self powered hydraulic catwalk may lift pipe up to 2000 lbs in weight to a height of 12 feet or more to the drill rig floor.

The self contained/self powered hydraulic catwalk disclosed herein can be constructed and configured in different sizes for many applications and is not limited to underground drilling operations. The self contained/self powered hydraulic catwalk can also be configured for lifting and removing pipe at offshore drilling rigs. The self contained/self powered hydraulic catwalk can be used for lifting or lowering elongated cylindrical poles for construction of utilities, buildings and other structures.

We claim:

1. A self contained/self powered hydraulic catwalk for pipe lay down and pipe pickup at a drilling rig comprising:

a frame;

a hydraulic lifting arm attached to said frame and congruent with a Vee trough;

a plurality of reversible kickers attached to said frame and positioned at intervals along said Vee trough;

a plurality of reversible indexers attached to said frame and positioned at intervals along said Vee trough;

a plurality of reversible roll offs attached to said frame and positioned at intervals along said Vee trough;

a pipe-pushing sled comprising a push face shaft, a sled push face, a pipe glove, a sled extend stop bumper, a sled retract stop bumper, a push face shaft sleeve, a push face spring, a drive chain, a sled drive motor sprocket and a sled drive motor attached to sled drive motor sprocket which moves along said Vee trough;

said Vee trough which extends parallel to said frame;

a lift arm slider attached to said hydraulic lifting arm;
a power supply;
a Vee roller attached to the end of said hydraulic lifting arm;
whereby as said hydraulic lifting arm is elevated, said lift arm slider attached to said hydraulic lifting arm moves-said hydraulic lifting arm maintaining the end of said hydraulic lifting arm in close proximity to the drilling rig and pipe is pushed by said pipe pushing sled through said Vee trough to said hydraulic lifting arm and over said Vee roller to the drill rig.

2. The self contained/self powered hydraulic catwalk for pipe lay down and pipe pick up at a drilling rig as defined in claim 1 wherein said power supply is an internal combustion engine fueled by gasoline.

3. The self contained/self powered hydraulic catwalk for pipe lay down and pipe pick up at a drilling rig as defined in claim 1 wherein said power supply is an internal combustion engine fueled by diesel fuel.

4. The self contained/self powered hydraulic catwalk for pipe lay down and pipe pick up at a drilling rig as defined in claim 1 wherein said power supply is electrically powered.

5. The self contained/self powered hydraulic catwalk for pipe lay down and pipe pick up at a drilling rig as defined in claim 1 wherein said indexer comprises:
an indexer top pipe cradle;
an indexer bottom pipe stop;
a pipe adjustable locator stop;
an indexer hydraulic cylinder.

6. The self contained/self powered hydraulic catwalk for pipe lay down and pipe pick up at a drilling rig as defined in claim 1 wherein said kicker comprises:
a kicker hydraulic cylinder;
a kicker guide spacer;
a kicker stop;
a kicker pivot pin.

7. The self contained/self powered hydraulic catwalk for pipe lay down and pipe pick up at a drilling rig as defined in claim 1 wherein said pipe pushing sled comprises:
a push face shaft;
a sled push face;
a pipe glove;
a sled extend stop bumper;
a sled retract stop bumper;
a push face shaft sleeve;
a push face spring;
a drive chain;
a sled drive motor sprocket;
a sled drive motor attached to said sled drive motor sprocket.

8. A self contained/self powered hydraulic catwalk for pipe lay down and pipe pickup at a drilling rig comprising:
a frame;
a hydraulic lifting arm attached to said frame and congruent with a Vee trough;
a plurality of reversible kickers attached to said frame and positioned at intervals along said Vee trough;
a plurality of reversible indexers attached to said frame and positioned at intervals along said Vee trough;
a plurality of reversible roll offs attached to said frame and positioned at intervals along said Vee trough;
a pipe-pushing sled comprising a push face shaft, a sled push face, a pipe glove, a sled extend stop bumper, a sled retract stop bumper, a push face shaft sleeve, a push face spring, a drive chain, a sled drive motor sprocket and a sled drive motor attached to sled drive motor sprocket which moves along said Vee trough;
a said Vee trough which extends parallel to said frame;
a lift arm slider attached to said hydraulic lifting arm;
a power supply;
a Vee roller attached to the end of said hydraulic lifting arm;
whereby as said hydraulic lifting arm is elevated, said lift arm slider attached to said hydraulic lifting arm moves-said hydraulic lifting arm maintaining the end of said hydraulic lifting arm in close proximity to the drilling rig and pipe is pushed by said pipe pushing sled through said Vee trough to said hydraulic lifting arm and over said Vee roller to the drill rig.

9. The self contained/self powered hydraulic catwalk for pipe lay down and pipe pick up at a drilling rig as defined in claim 8 wherein said hydraulic lift arm comprises:
a Vee shaped lift arm;
a boom attached to said Vee shaped lift arm and at the other end to said frame;
a hydraulic cylinder attached on one end to said boom and at the other end to said frame.

10. The self contained/self powered hydraulic catwalk for pipe lay down and pipe pick up at a drilling rig as defined in claim 8 wherein said power supply is an internal combustion engine fueled by gasoline.

11. The self contained/self powered hydraulic catwalk for pipe lay down and pipe pick up at a drilling rig as defined in claim 8 wherein said power supply is an internal combustion engine fueled by diesel fuel.

12. The self contained/self powered hydraulic catwalk for pipe lay down and pipe pick up at a drilling rig as defined in claim 8 wherein said power supply is electrically powered.

13. The self contained/self powered hydraulic catwalk for pipe lay down and pipe pick up at a drilling rig as defined in claim 8 wherein said indexer comprises:
an indexer top pipe cradle;
an indexer bottom pipe stop;
a pipe adjustable locator stop;
an indexer hydraulic cylinder.

14. The self contained/self powered hydraulic catwalk for pipe lay down and pipe pick up at a drilling rig as defined in claim 8 wherein said kicker comprises:
a kicker hydraulic cylinder;
a kicker guide spacer;
a kicker stop;
a kicker pivot pin.

15. The self contained/self powered hydraulic catwalk for pipe lay down and pipe pick up at a drilling rig as defined in claim 8 wherein said pipe pushing sled comprises:
a push face shaft;
a sled push face;
a pipe glove;
a sled extend stop bumper;
a sled retract stop bumper;
a push face shaft sleeve;
a push face spring;
a drive chain;
a sled drive motor sprocket;
a sled drive motor attached to said sled drive motor sprocket.

16. The self contained/self powered hydraulic catwalk for pipe lay down and pipe pick up at a drilling rig as defined in claim 8 wherein said hydraulic lift arm comprises:
a Vee shaped lift arm;

a boom attached to said Vee shaped lift arm and at the other end to said frame;

a hydraulic cylinder attached on one end to said boom and at the other end to said frame.

17. A self contained/self powered hydraulic catwalk for pipe lay down and pipe pick up at a drilling rig comprising:

a frame;

a hydraulic lifting arm attached to said frame and congruent with a Vee trough;

a plurality of reversible kickers attached to said frame and positioned at intervals along said Vee trough;

a plurality of reversible indexers attached to said frame and positioned at intervals along said Vee trough;

a plurality of reversible roll offs attached to said frame and positioned at intervals along said Vee trough;

a pipe-pushing sled comprising a push face shaft, a sled push face, a pipe glove, a sled extend stop bumper, a sled retract stop bumper, a push face shaft sleeve, a push face spring, a drive chain, a sled drive motor sprocket and a sled drive motor attached to sled drive motor sprocket which moves along said Vee trough;

said Vee trough which extends parallel to said frame;

a lift arm slider attached to said hydraulic lifting arm;

a power supply;

a Vee roller attached to the end of said hydraulic lifting arm;

a removable extension attached to the end of said hydraulic lift arm;

a scissors lift;

whereby pipe is loaded from a storage rack into said Vee trough by said scissors lift, said indexers, said roll offs and pushed by said pipe pushing sled and as said hydraulic lifting arm is elevated, said lift arm slider attached to said hydraulic lifting arm moves said hydraulic lifting arm maintaining the distal end of said hydraulic lifting arm in close proximity to the drilling rig, the pipe is pushed by said pipe pushing sled through said Vee trough to said hydraulic lifting arm and over said Vee roller to the drill rig.

18. The self contained/self powered hydraulic catwalk for pipe lay down and pipe pick up at a drilling rig as defined in claim 17 wherein said power supply is an internal combustion engine fueled by gasoline.

19. The self contained/self powered hydraulic catwalk for pipe lay down and pipe pick up at a drilling rig as defined in claim 17 wherein said power supply is an internal combustion engine fueled by diesel fuel.

20. The self contained/self powered hydraulic catwalk for pipe lay down and pipe pick up at a drilling rig as defined in claim 17 wherein said power supply is electrically powered.

21. The self contained/self powered hydraulic catwalk for pipe lay down and pipe pick up at a drilling rig as defined in claim 17 wherein said indexer comprises:

an indexer top pipe cradle;

an indexer bottom pipe stop;

a pipe adjustable locator stop;

an indexer hydraulic cylinder.

22. The self contained/self powered hydraulic catwalk for pipe lay down and pipe pick up at a drilling rig as defined in claim 17 wherein said kicker comprises:

a kicker hydraulic cylinder;

a kicker guide spacer;

a kicker stop;

a kicker pivot pin.

23. The self contained/self powered hydraulic catwalk for pipe lay down and pipe pick up at a drilling rig as defined in claim 17 wherein said pipe pushing sled comprises:

a push face shaft;

a sled push face;

a pipe glove;

a sled extend stop bumper;

a sled retract stop bumper;

a push face shaft sleeve;

a push face spring;

a drive chain;

a sled drive motor sprocket;

a sled drive motor attached to said sled drive motor sprocket.

24. The self contained/self powered hydraulic catwalk for pipe lay down and pipe pick up at a drilling rig as defined in claim 17 wherein said hydraulic lift arm comprises:

a Vee shaped lift arm;

a boom attached to said lift arm and at the other end to said frame;

a hydraulic cylinder attached on one end to said boom and at the other end to said frame.

* * * * *